US009572398B2

(12) United States Patent
Hurd et al.

(10) Patent No.: US 9,572,398 B2
(45) Date of Patent: Feb. 21, 2017

(54) SOLE STRUCTURE WITH ALTERNATING SPRING AND DAMPING LAYERS

(71) Applicant: NIKE, Inc., Beaverton, OR (US)

(72) Inventors: John Hurd, Tigard, OR (US); Shane S. Kohatsu, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 412 days.

(21) Appl. No.: 13/661,963

(22) Filed: Oct. 26, 2012

(65) Prior Publication Data

US 2014/0115925 A1 May 1, 2014

(51) Int. Cl.

*A43B 13/12* (2006.01)
*A43B 13/14* (2006.01)
*A43B 13/18* (2006.01)

(52) U.S. Cl.

CPC ..... *A43B 13/122* (2013.01); *A43B 13/125* (2013.01); *A43B 13/145* (2013.01); *A43B 13/181* (2013.01); *A43B 13/183* (2013.01); *A43B 13/185* (2013.01); *A43B 13/187* (2013.01)

(58) Field of Classification Search

CPC ..... A43B 13/12; A43B 13/183; A43B 13/184; A43B 13/185; A43B 13/122; A43B 13/125; A43B 13/181; A43B 13/187
USPC ..... 36/27, 28, 30 R, 35 R, 38, 103
See application file for complete search history.

(56) References Cited

U.S. PATENT DOCUMENTS 1,689,633 A 10/1928 Lupien
2,118,255 A 5/1938 Loucks et al.
2,124,727 A 7/1938 Bown
3,397,418 A 8/1968 Steadman et al.
4,566,206 A 1/1986 Weber
4,592,153 A 6/1986 Jacinto
4,764,238 A * 8/1988 Dastin ..... B29C 70/086 156/245
4,771,554 A 9/1988 Hannemann
4,890,397 A * 1/1990 Harada et al. ..... 36/30 R
5,203,095 A 4/1993 Allen
5,367,790 A 11/1994 Gamow et al.
5,701,686 A 12/1997 Herr et al.
5,718,063 A * 2/1998 Yamashita et al. ..... 36/28
5,937,544 A * 8/1999 Russell ..... 36/28
5,940,994 A * 8/1999 Allen ..... 36/168
(Continued)

FOREIGN PATENT DOCUMENTS

EP 1402796 A1 3/2004
EP 2446768 A2 5/2012
(Continued)

OTHER PUBLICATIONS

International Search Report and Written Opinion for PCT/US2013/066148 mailed Jul. 22, 2014.
(Continued)

*Primary Examiner* — Anna Kinsaul
*Assistant Examiner* — Jocelyn Wu
(74) *Attorney, Agent, or Firm* — Banner & Witcoff, Ltd.

(57) ABSTRACT

A sole structure may include multiple macrolayers. Each of those macrolayers may include a spring plate and a layer of damping material. Macrolayers may be bonded or otherwise fixed relative to one another and provide constrained layer damping in response to impact forces occurring as a result of activity of a wearer of an article of footwear incorporating the sole structure.

23 Claims, 21 Drawing Sheets

(56) References Cited

U.S. PATENT DOCUMENTS

| | | | | |
|---|---|---|---|---|
| 5,974,696 | A * | 11/1999 | Aird et al. | 36/31 |
| 6,000,148 | A | 12/1999 | Cretinon | |
| 6,009,641 | A | 1/2000 | Ryan | |
| 6,029,374 | A | 2/2000 | Herr et al. | |
| 6,499,235 | B2 | 12/2002 | Lussier et al. | |
| 6,694,642 | B2 * | 2/2004 | Turner | 36/28 |
| 6,763,616 | B2 | 7/2004 | Ellis, III | |
| 6,807,753 | B2 | 10/2004 | Steszyn et al. | |
| 6,925,732 | B1 | 8/2005 | Clarke | |
| 6,944,972 | B2 | 9/2005 | Schmid | |
| 7,016,867 | B2 | 3/2006 | Lyden | |
| 7,082,702 | B2 | 8/2006 | Cretinon | |
| 7,100,308 | B2 * | 9/2006 | Aveni | 36/27 |
| 7,299,567 | B2 | 11/2007 | Berend et al. | |
| 7,401,419 | B2 | 7/2008 | Lucas et al. | |
| 7,401,422 | B1 | 7/2008 | Scholz et al. | |
| 7,464,489 | B2 * | 12/2008 | Ho | 36/28 |
| 7,475,497 | B2 | 1/2009 | Hoffer et al. | |
| 7,559,157 | B2 * | 7/2009 | Polegato Moretti | 36/3 B |
| 7,559,158 | B2 * | 7/2009 | Rosendahl | 36/29 |
| 7,673,397 | B2 * | 3/2010 | Jarvis | A43B 13/12 36/25 R |
| 7,941,938 | B2 | 5/2011 | Yu et al. | |
| 7,946,059 | B2 | 5/2011 | Borel | |
| 7,954,257 | B2 * | 6/2011 | Banik | 36/28 |
| 7,954,259 | B2 | 6/2011 | Antonelli et al. | |
| 7,980,006 | B2 | 7/2011 | Aveni et al. | |
| 7,987,618 | B2 | 8/2011 | Nishiwaki et al. | |
| 8,056,263 | B2 | 11/2011 | Schindler et al. | |
| 8,151,485 | B2 | 4/2012 | Hurd et al. | |
| 8,291,618 | B2 * | 10/2012 | Ellis | 36/103 |
| 8,707,583 | B2 * | 4/2014 | Caron et al. | 36/29 |
| 8,813,390 | B2 * | 8/2014 | Auger et al. | 36/30 R |
| 2002/0011146 | A1 * | 1/2002 | Vaz | 89/36.05 |
| 2002/0023374 | A1 * | 2/2002 | Russell | 36/28 |
| 2002/0050079 | A1 * | 5/2002 | Yoshiaki | 36/132 |
| 2002/0162248 | A1 * | 11/2002 | Otis et al. | 36/59 R |
| 2002/0174567 | A1 | 11/2002 | Krafsur et al. | |
| 2003/0000109 | A1 * | 1/2003 | Kita | 36/30 R |
| 2003/0009910 | A1 * | 1/2003 | Pavone | 36/29 |
| 2003/0061731 | A1 | 4/2003 | Turner et al. | |
| 2003/0079373 | A1 * | 5/2003 | Geer et al. | 36/3 B |
| 2003/0093920 | A1 * | 5/2003 | Greene et al. | 36/25 R |
| 2003/0101620 | A1 * | 6/2003 | Reed et al. | 36/30 A |
| 2003/0121179 | A1 * | 7/2003 | Chen | 36/30 R |
| 2003/0131499 | A1 | 7/2003 | Silverman | |
| 2004/0148809 | A1 | 8/2004 | Kikuta et al. | |
| 2004/0163280 | A1 * | 8/2004 | Morris et al. | 36/28 |
| 2004/0168350 | A1 * | 9/2004 | Mathieu et al. | 36/25 R |
| 2004/0194351 | A1 * | 10/2004 | Gallegos | 36/140 |
| 2005/0000115 | A1 | 1/2005 | Kimura et al. | |
| 2005/0102857 | A1 | 5/2005 | Yen | |
| 2005/0132608 | A1 * | 6/2005 | Dojan et al. | 36/29 |
| 2006/0021252 | A1 * | 2/2006 | Throneburg et al. | 36/44 |
| 2006/0201028 | A1 * | 9/2006 | Chan et al. | 36/28 |
| 2006/0283045 | A1 * | 12/2006 | Kita et al. | 36/28 |
| 2007/0028484 | A1 * | 2/2007 | Akhidime | 36/28 |
| 2007/0101617 | A1 | 5/2007 | Brewer et al. | |
| 2007/0186446 | A1 * | 8/2007 | Lafortune | 36/43 |
| 2007/0295451 | A1 * | 12/2007 | Willis | 156/306.6 |
| 2008/0052965 | A1 | 3/2008 | Sato | |
| 2008/0115389 | A1 | 5/2008 | Hsieh | |
| 2008/0289220 | A1 | 11/2008 | Rivas et al. | |
| 2009/0013556 | A1 * | 1/2009 | Nishiwaki et al. | 36/28 |
| 2009/0019727 | A1 * | 1/2009 | Fenzi | 36/44 |
| 2009/0165333 | A1 * | 7/2009 | Litchfield et al. | 36/88 |
| 2009/0183387 | A1 * | 7/2009 | Ellis | 36/29 |
| 2009/0241377 | A1 * | 10/2009 | Kita et al. | 36/107 |
| 2010/0050471 | A1 * | 3/2010 | Kim | 36/29 |
| 2010/0058616 | A1 | 3/2010 | Ryoo | |
| 2010/0064549 | A1 * | 3/2010 | Geer et al. | 36/28 |
| 2010/0122471 | A1 * | 5/2010 | Edington et al. | 36/28 |
| 2010/0146819 | A1 * | 6/2010 | Teteriatnikov et al. | 36/103 |
| 2010/0146825 | A1 * | 6/2010 | Teteriatnikov et al. | 36/30 R |
| 2010/0170106 | A1 | 7/2010 | Brewer et al. | |
| 2010/0236096 | A1 * | 9/2010 | Pauk et al. | 36/28 |
| 2010/0236098 | A1 * | 9/2010 | Morgan | 36/91 |
| 2010/0307025 | A1 * | 12/2010 | Truelsen et al. | 36/28 |
| 2010/0307028 | A1 * | 12/2010 | Teteriatnikov et al. | 36/108 |
| 2011/0009982 | A1 | 1/2011 | King et al. | |
| 2011/0113656 | A1 * | 5/2011 | Sato | 36/30 R |
| 2011/0131842 | A1 * | 6/2011 | Sek | 36/30 R |
| 2011/0138651 | A1 * | 6/2011 | Nishiwaki et al. | 36/28 |
| 2011/0138652 | A1 | 6/2011 | Lucas et al. | |
| 2011/0162231 | A1 * | 7/2011 | Perenich | 36/27 |
| 2011/0239489 | A1 * | 10/2011 | Iuchi et al. | 36/30 R |
| 2011/0271555 | A1 | 11/2011 | Baudouin | |
| 2012/0023784 | A1 * | 2/2012 | Goldston et al. | 36/137 |
| 2012/0030971 | A9 * | 2/2012 | Truelsen | 36/30 R |
| 2012/0036740 | A1 * | 2/2012 | Gerber | 36/134 |
| 2012/0042538 | A1 * | 2/2012 | Nishiwaki et al. | 36/28 |
| 2012/0042541 | A1 * | 2/2012 | Miner | 36/88 |
| 2012/0055041 | A1 * | 3/2012 | Mackey et al. | 36/28 |
| 2012/0060395 | A1 | 3/2012 | Blevens et al. | |
| 2012/0144695 | A1 * | 6/2012 | McDowell et al. | 36/28 |
| 2012/0159812 | A1 * | 6/2012 | Hurd et al. | 36/83 |
| 2012/0174432 | A1 * | 7/2012 | Peyton | 36/28 |
| 2012/0266492 | A1 * | 10/2012 | Youngs et al. | 36/83 |
| 2012/0311892 | A1 * | 12/2012 | Peikert | 36/30 R |
| 2013/0000146 | A1 * | 1/2013 | Brandstatter | 36/28 |
| 2013/0074364 | A1 * | 3/2013 | Lim | 36/28 |
| 2013/0152430 | A1 * | 6/2013 | Bier et al. | 36/3 A |
| 2013/0160223 | A1 * | 6/2013 | Bier et al. | 12/146 B |
| 2014/0090276 | A1 * | 4/2014 | Goldston et al. | 36/102 |
| 2014/0360046 | A1 * | 12/2014 | Dojan et al. | 36/29 |

FOREIGN PATENT DOCUMENTS

| | | | |
|---|---|---|---|
| GB | 2171890 | | 9/1986 |
| WO | 2004/089609 | A1 | 10/2004 |

OTHER PUBLICATIONS

Renninger, "Understanding Damping Techniques for Noise and Vibration Control", downloaded Sep. 21, 2012, from <http://www.earsc.com/pdfs/engineering/understandingdamping.pdf>, 8 pages.

Invitation to Pay Additional Fees with Partial International Search Report for PCT/US2013/066148 mailed Feb. 17, 2014.

Less Cowbell! The Unconstrained Truth About Constrained-Layer Damping, <http://www.sciencebuddies.org/science-fair-projects/project_ideas/Apm . . .>, printed Sep. 21, 2012, 8 pages.

Jul. 22, 2015 (EP)—European Search Report App. No. 15161994.

Jun. 3, 2016 (CN)—Office Action App. No. 201380051998.1.

* cited by examiner

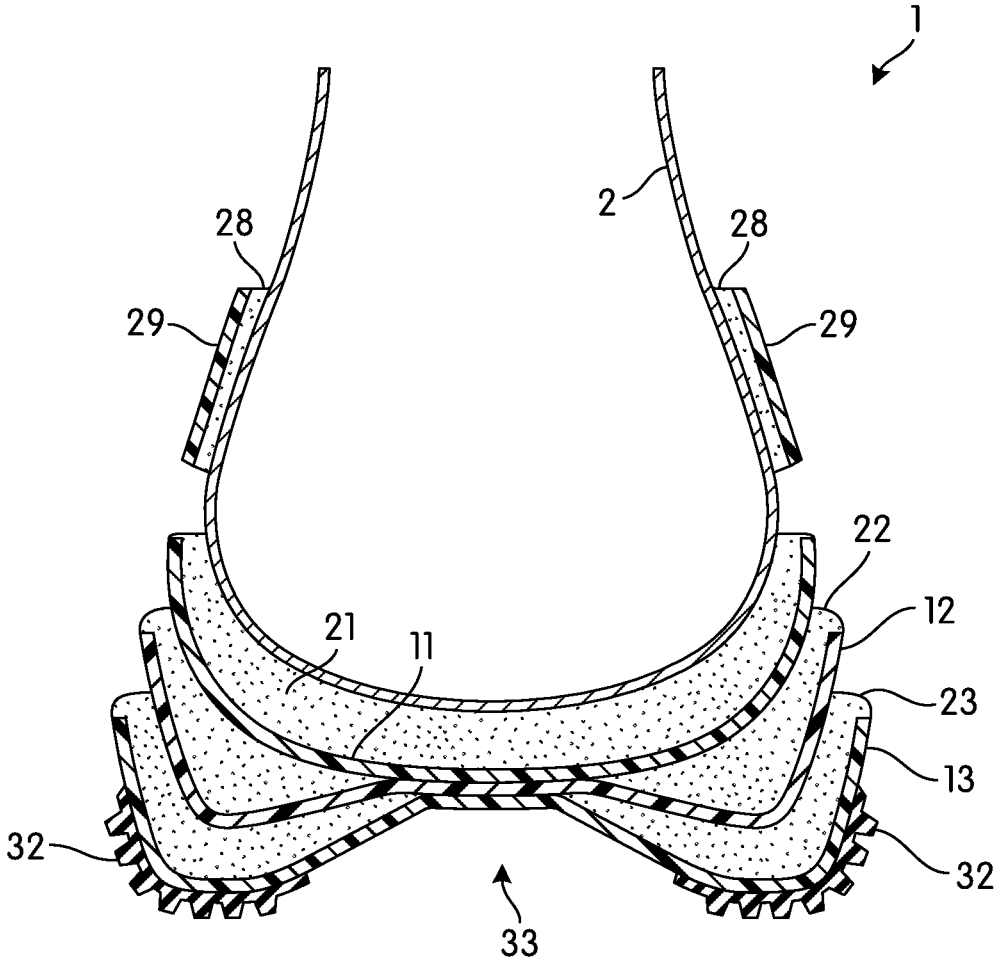
FIG. 4A1

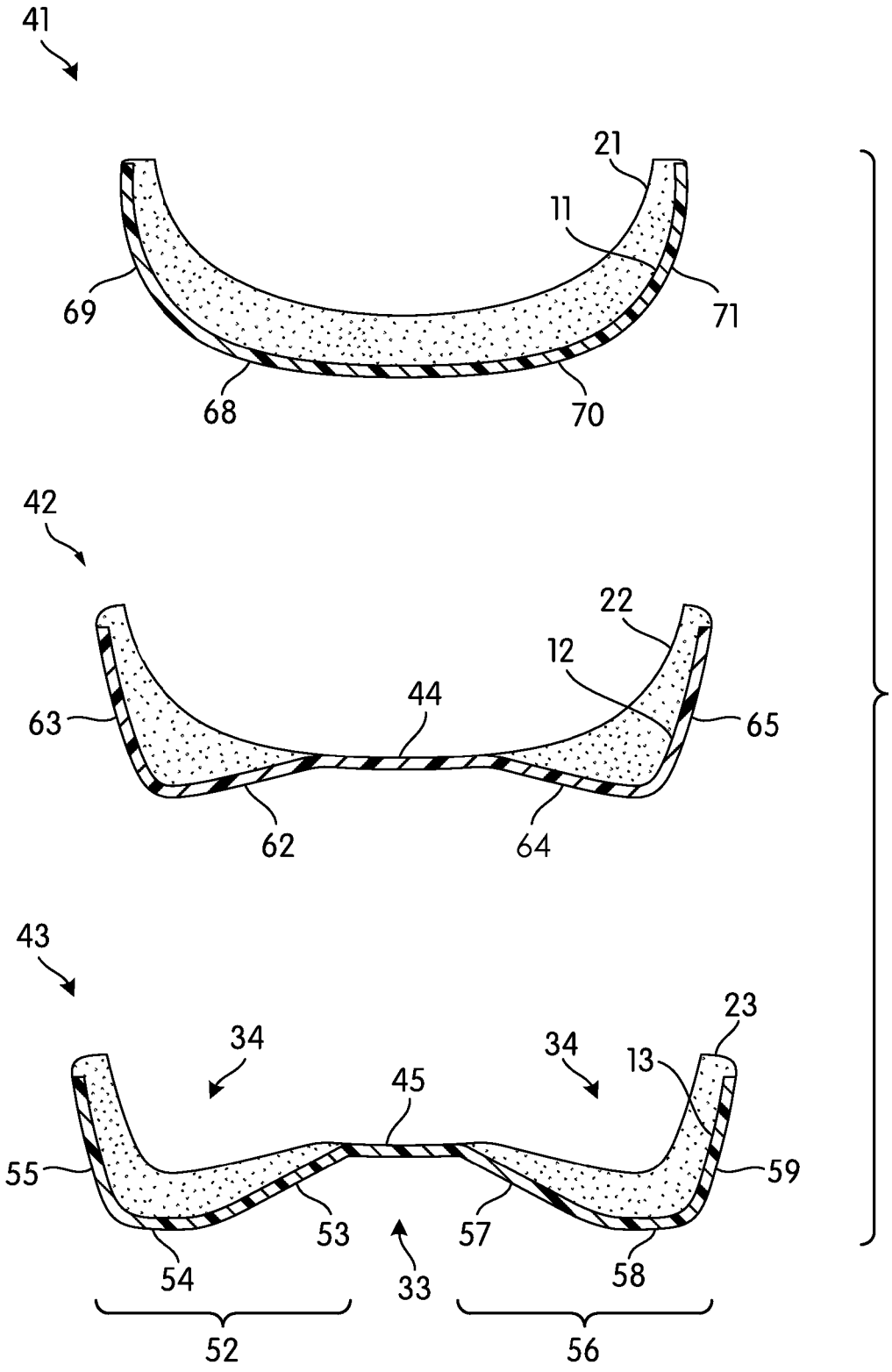
FIG. 4A2

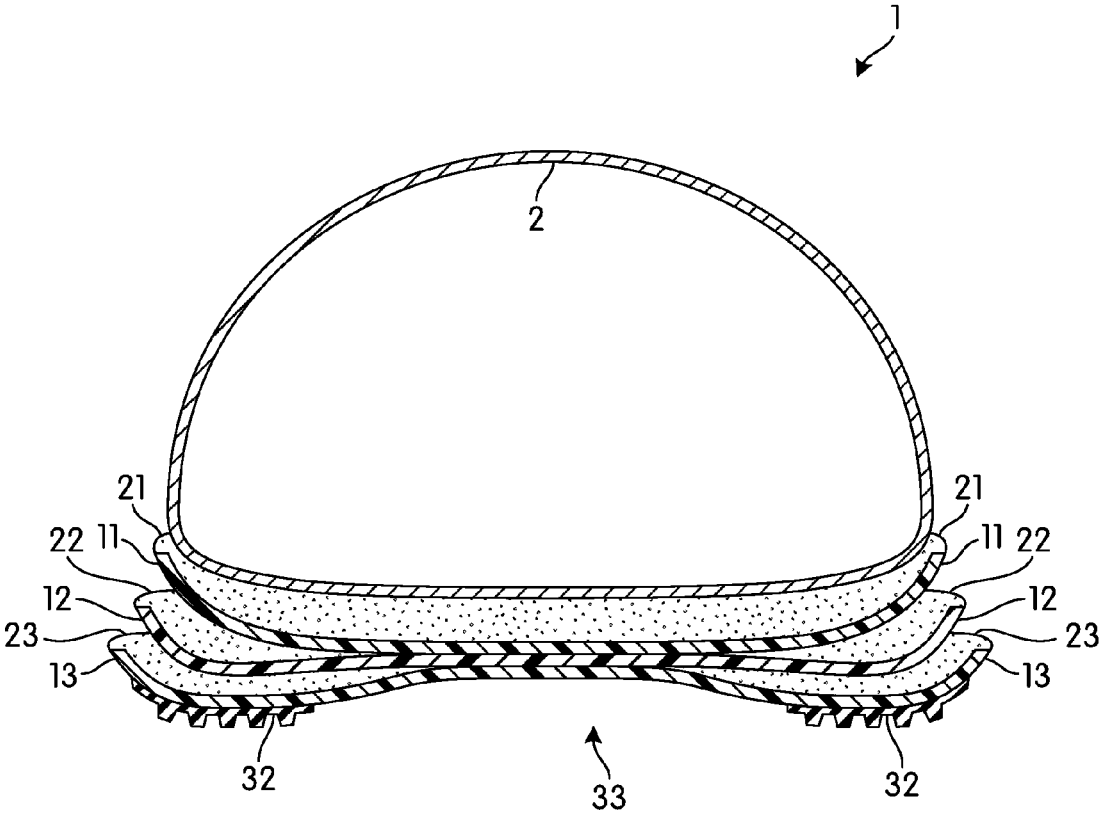
FIG. 4B1

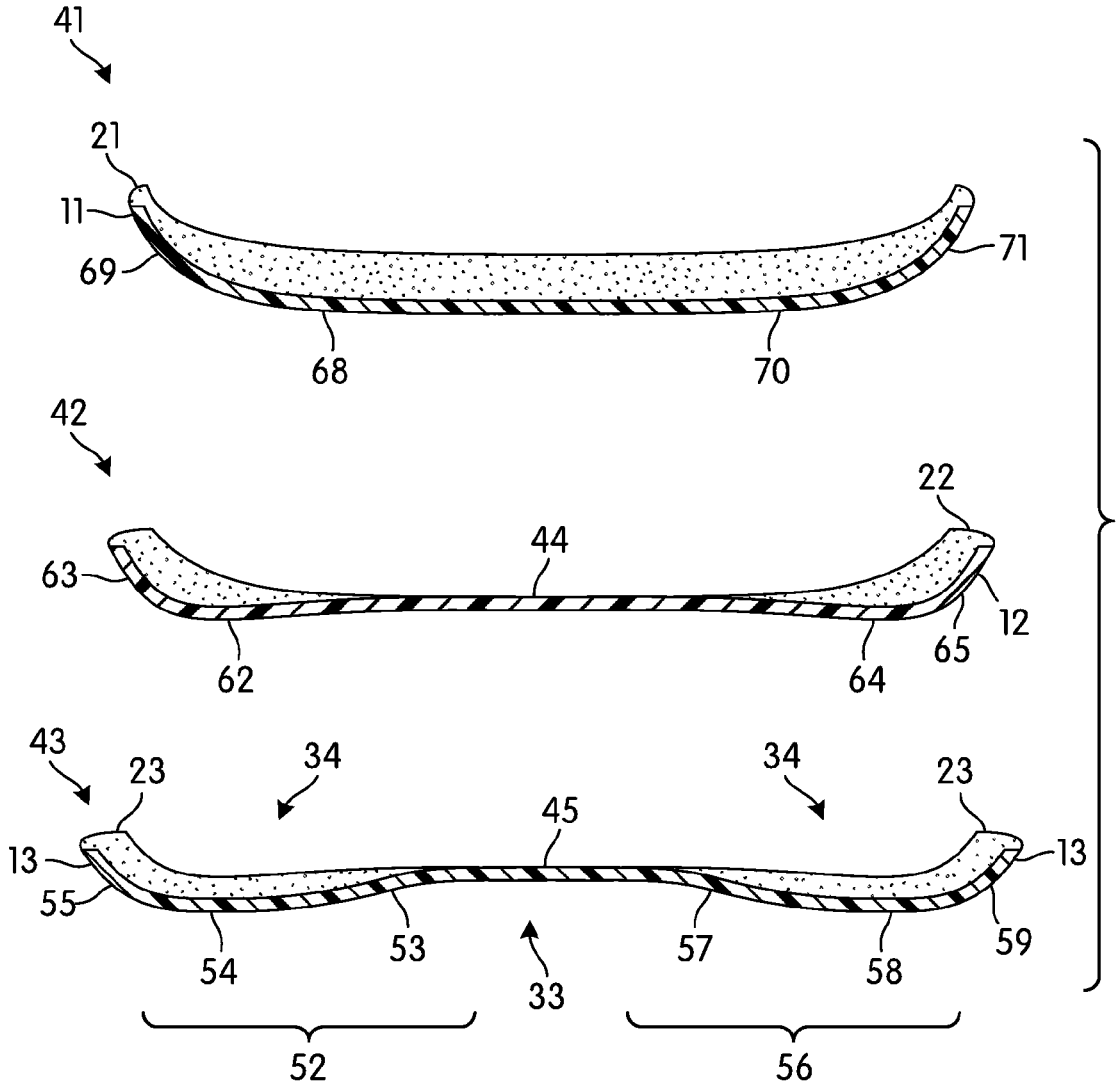
FIG. 4B2

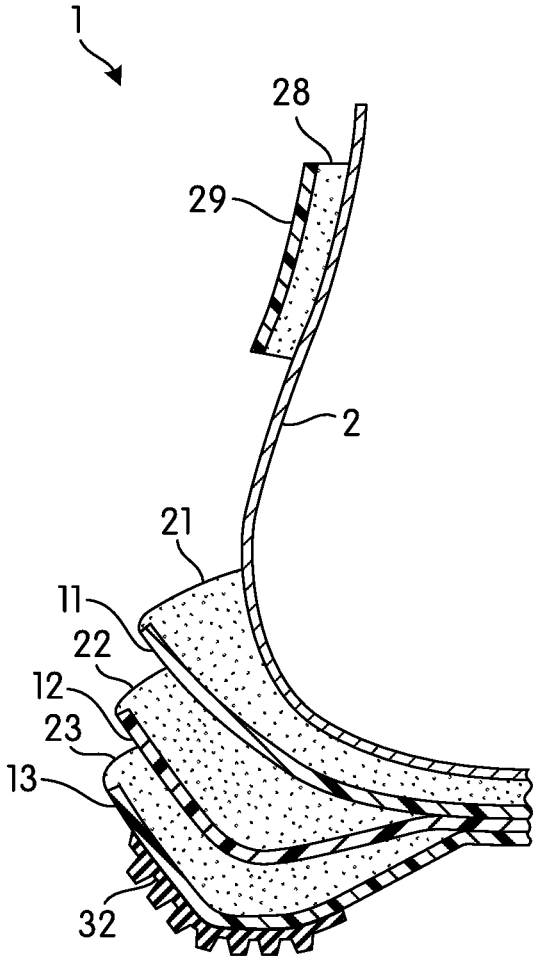
FIG. 4C1

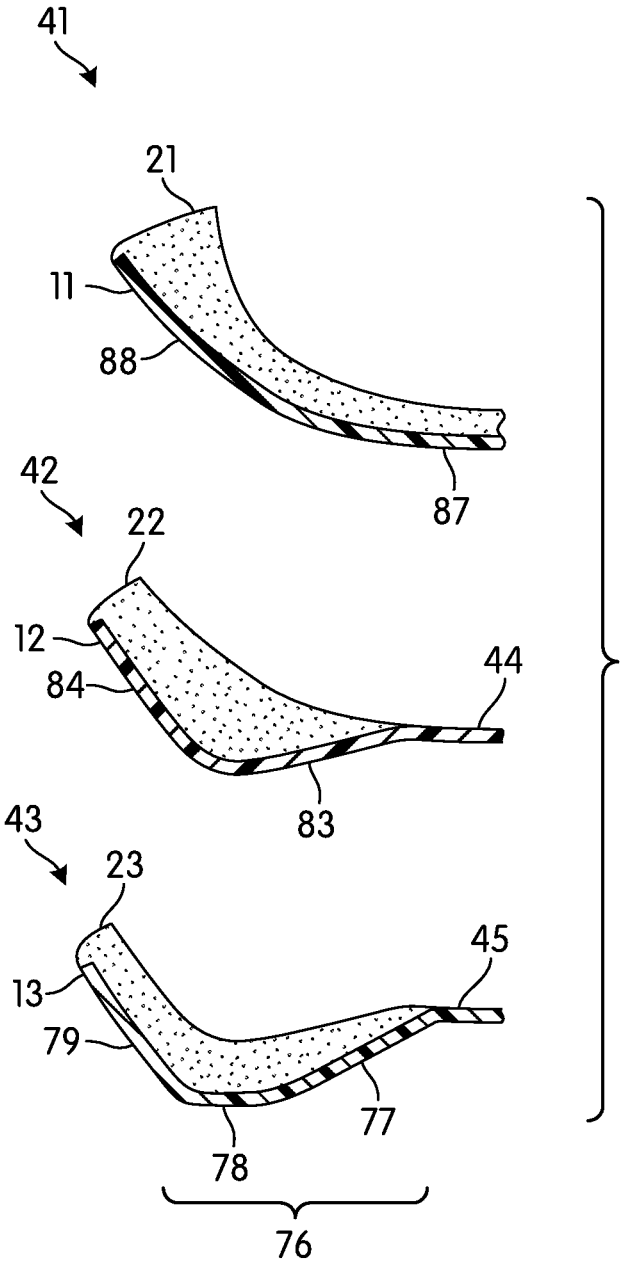
FIG. 4C2

SOLE STRUCTURE WITH ALTERNATING SPRING AND DAMPING LAYERS

BACKGROUND

Footwear normally includes an upper and a sole structure. Typically, the upper covers at least part of the shoe wearer foot and secures the foot relative to the sole structure. The sole structure is generally secured to a bottom surface or other portion of the upper and is positioned between the wearer foot and the ground when the wearer is standing. In addition to providing traction, a sole structure may protect a shoe wearer foot and promote wearer comfort.

In particular, many footwear designs rely upon a sole structure to attenuate ground reaction forces and absorb energy as the wearer walks, runs or performs other maneuvers. These sole structure functions, which are sometimes referred to generally as "cushioning," can be performed using a variety of structures. Often, these structures may take the form of a midsole and/or outsole that is formed from a compressible foam or other similar material. Other energy absorbing structures have included spring-like elements.

Difficulties may arise when designing sole structures for use in footwear intended for specific activities. For instance, some sports and other activities may involve motion that is primarily linear, e.g., walking or running in a generally straight line. For shoes intended for wear during those activities, it may be advantageous to include support and/or cushioning that is concentrated in foot regions that may experience high impact during running or walking. Other activities may involve a significant amount of "cutting" maneuvers in which a shoe wearer moves rapidly to the side. For shoes intended for wear during those activities, it may be advantageous to include additional support and/or cushioning in foot regions that may experience high impact during cutting. Numerous other factors can influence the performance criteria for a shoe design. Such factors can include, without limitation, the hardness of a surface on which the shoe will be worn, differing foot anatomies and preferences of individual shoe wearers. With conventional sole structures, difficulties can often arise when attempting to create or adapt a sole structure design to accommodate a particular activity, user preference and/or other factors.

SUMMARY

This Summary is provided to introduce a selection of concepts in a simplified form that are further described below in the Detailed Description. This Summary is not intended to identify key features or essential features of the invention.

In at least some embodiments, a sole structure may include multiple macrolayers. Each of those macrolayers may include a spring plate and a layer of damping material. Macrolayers may be bonded, or otherwise fixed relative to one another, in one or more portions of the macrolayers.

In certain embodiments, a sole structure may include a first spring plate having an upwardly extending first medial outer edge and an upwardly extending first lateral outer edge. The sole structure may also include a second spring plate having an upwardly extending second medial outer edge and an upwardly extending second lateral outer edge. The sole structure may further include a damping material layer having portions located between the first and second medial outer edges and between the first and second lateral outer edges.

In further embodiments, a sole structure may include a first spring plate, a second spring plate and a damping material layer. The second spring plate may include a portion located in a longitudinally extending central region of the second spring plate. The second spring plate attachment portion may be directly bonded to, or otherwise fixed relative to, a corresponding portion of the first spring plate. The damping material layer may be located between the first and second spring plates in regions surrounding the attachment portion.

Additional embodiments may include, without limitation, other sole structures, shoes incorporating sole structures, and methods for manufacturing sole structures and/or shoes incorporating sole structures.

BRIEF DESCRIPTION OF THE DRAWINGS

Some embodiments are illustrated by way of example, and not by way of limitation, in the figures of the accompanying drawings and in which like reference numerals refer to similar elements.

FIG. 4A1 is an enlarged, partially schematic, area cross-sectional view from the location indicated in FIG. 1.

FIG. 4A2 is a partially exploded version of the area cross-sectional view of FIG. 4A1, and with certain elements omitted.

FIG. 4B1 is an enlarged, partially schematic, area cross-sectional view from another location indicated in FIG. 1.

FIG. 4B2 is a partially exploded version of the area cross-sectional view of FIG. 4B1, and with certain elements omitted.

FIG. 4C1 is an enlarged, rotated, partially schematic, area cross-sectional view from the location indicated in FIG. 2E.

FIG. 4C2 is a partially exploded version of the area cross-sectional view of FIG. 4C1, and with certain elements omitted.

DETAILED DESCRIPTION

Definitions

Figure 1:
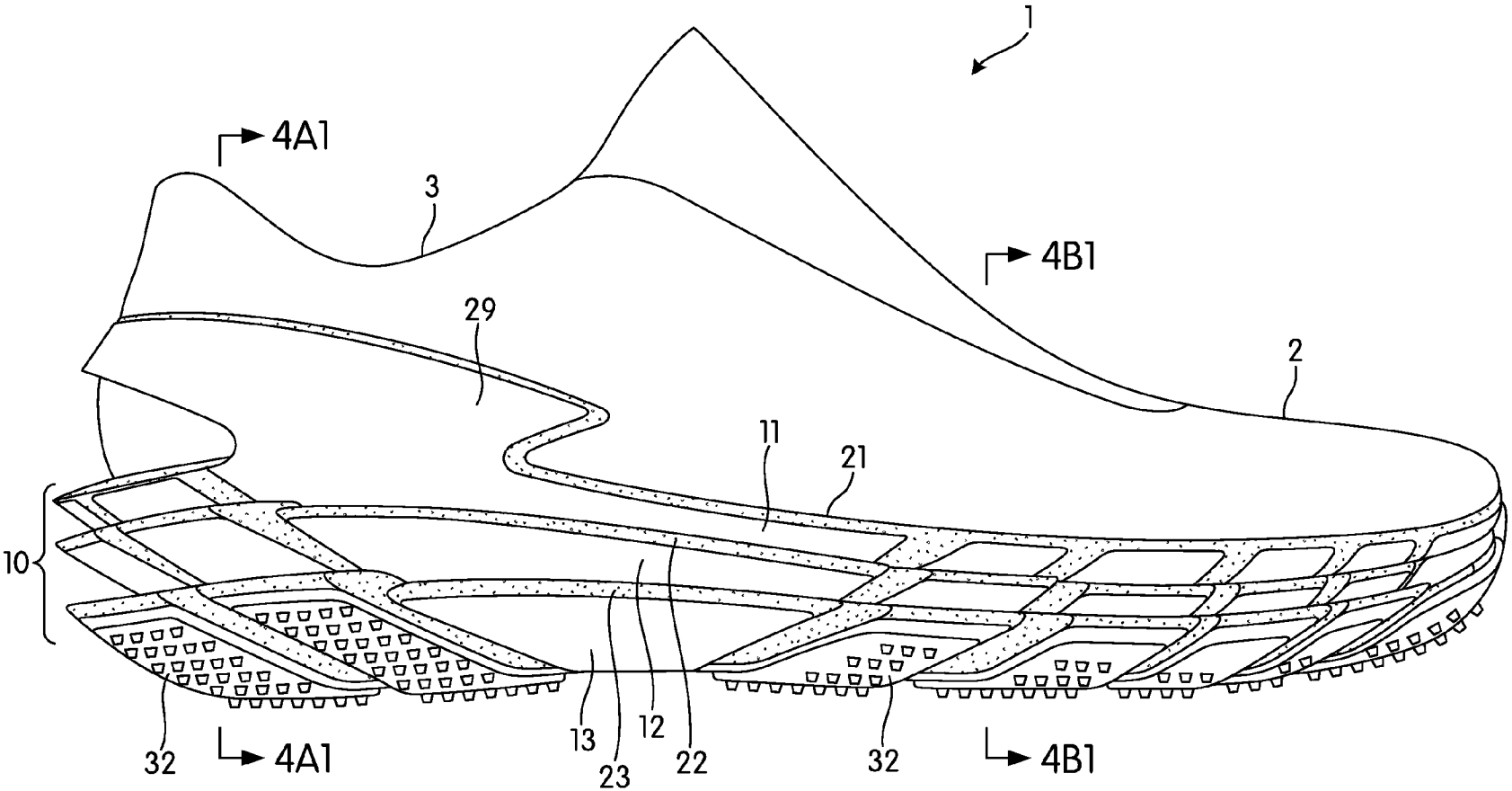
FIG. 1 is a lateral side view of a shoe according to at least some embodiments.

To assist and clarify subsequent description of various embodiments, various terms are defined herein. Unless context indicates otherwise, the following definitions apply throughout this specification (including the claims). "Shoe" and "article of footwear" are used interchangeably to refer to an article intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An interior side, surface, face or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Unless the context indicates otherwise, "top," "bottom," "over," "under," "above," "below," and similar locational words assume that a shoe or shoe structure of interest is in the orientation that would result if the shoe (or shoe incorporating the shoe structure of interest) is in an undeformed condition with its outsole resting on a flat horizontal surface. Notably, however, the term "upper" is reserved for use in describing the component of a shoe that at least partially covers a wearer foot and helps to secure the wearer foot to a shoe sole structure.

A "longitudinal" foot axis refers to a horizontal heel-toe axis along the center of the foot, while that foot is resting on a horizontal surface, that is generally parallel to a line along the second metatarsal and second phalangeal bones. A "transverse" foot axis refers to a horizontal axis across the foot that is generally perpendicular to the longitudinal axis. A longitudinal direction is parallel to the longitudinal axis or has a primary directional component that is parallel to the longitudinal axis. A transverse direction is parallel to a transverse axis or has a primary directional component that is parallel to a transverse axis. "Medial" and "lateral" have the meanings conventionally used in connection with footwear and/or foot anatomy.

Shoe elements can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial side of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial side of a wearer's midfoot (or portion thereof) when the shoe is worn. As a further example, a heel region of a foot includes the talus and calcaneus bones. A heel element of a shoe is an element having one or more portions located over, under, to the lateral and/or medial side of, and/or behind a wearer's midfoot (or portion thereof) when the shoe is worn. The forefoot region may overlap with the midfoot region, as may the midfoot and heel regions.

Exemplary Embodiments

Constrained layer damping is a technique that has been used for soundproofing and for other purposes. For example, constrained layer damping has been used in equipment such as electron microscopes, turntables and other devices in which vibration damping is desirable. Multiple levels of constrained layer damping can be combined to dampen several ranges of vibration frequencies. For example, a first level of constrained layer damping (useful to dampen vibrations in frequency range A) can be combined with a second level of constrained layer damping (useful to dampen vibrations in frequency range B) to dampen frequencies in the range A+B. At least some embodiments of the invention employ constrained layer damping in a sole structure to absorb energy when that sole structure impacts the ground during wearer activity.

In constrained layer damping, a viscoelastic layer is sandwiched between two elastic layers. When a force is applied to a first of the elastic layers, that first layer deforms. The deformation of the first elastic layer is transferred through the viscoelastic layer and to the second elastic layer. However, deformation also causes the elastic layers to move in shear relative to one another, particularly if the elastic layers are both curved or otherwise non-flat. This shear movement is also translated to the viscoelastic layer. A portion of the energy associated with that shear motion is absorbed by the viscoelastic layer and converted to heat. As a result, less of the mechanical energy from the original force application to the first elastic layer is available for transfer to the second elastic layer.

FIG. 1 is a lateral side view of a shoe 1, according to at least some embodiments, that includes a sole structure configured to utilize constrained layer damping. Shoe 1 includes an upper 2 attached to a sole structure 10. Upper 1 includes an opening 3 through which a wearer may insert a foot, after which upper 2 may be tightened so as to secure shoe 1 to the wearer foot. Upper 2 may include laces, straps and/or other elements (not shown) that may be used to tighten upper 2 onto the wearer foot. Shoes according to different embodiments may be specially configured for particular sports (e.g., running, basketball, etc.) or other activities. Accordingly, upper 2 may include features adapted for wear during specific activities. Additional reference numbers in FIG. 1 will be identified in connection with additional drawing figures.

Figure 2A:
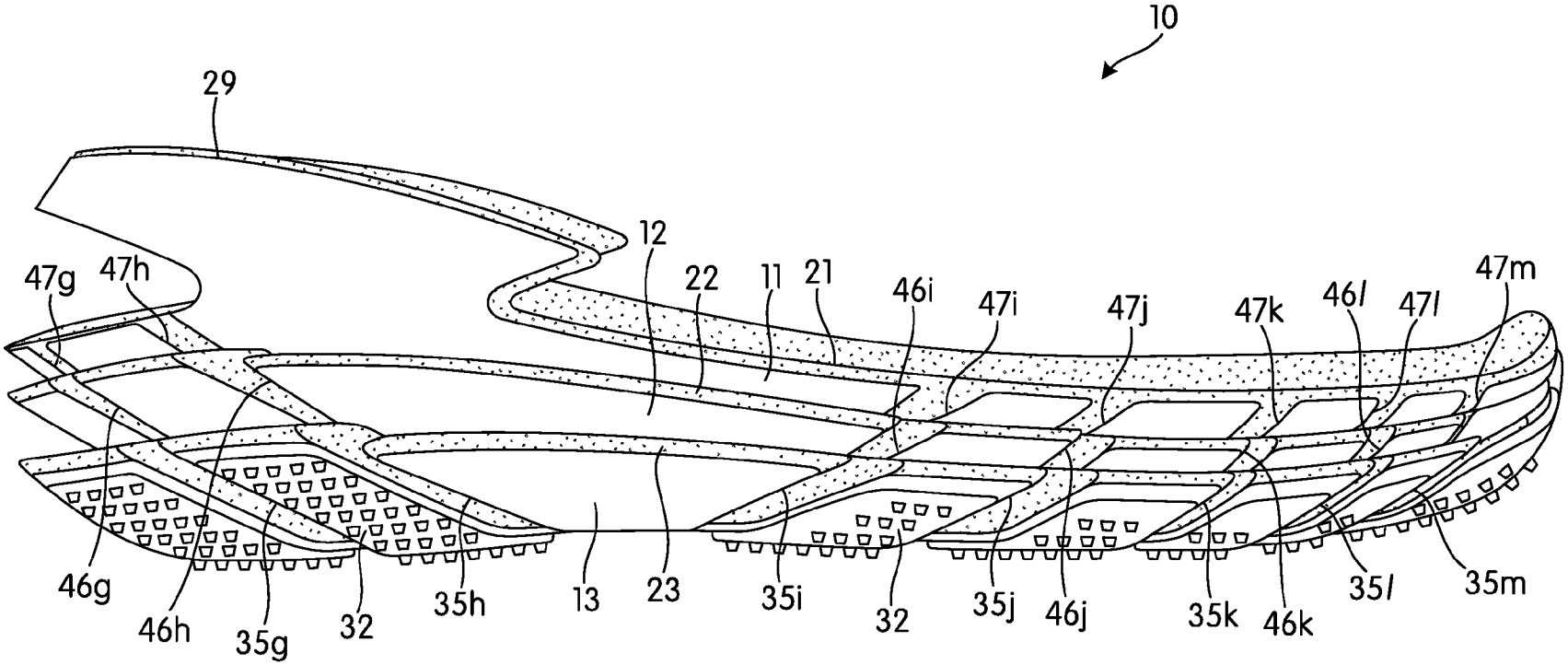
FIGS. 2A through 2E are respective lateral side, medial side, rear, top front medial perspective and bottom views of the sole structure from the shoe shown in FIG. 1.

FIG. 2A is a lateral side view of sole structure 10 with upper 1 omitted. FIGS. 2B through 2E are respective medial side, rear, top front medial perspective and bottom views of sole structure 10. Sole structure 10 includes alternating layers of spring plates and damping material. In particular, sole structure 10 includes three spring plates 11, 12 and 13 and three damping material layers 21, 22 and 23. Spring plates 11, 12 and 13 form elastic layers of a constrained layer damping system. Damping material layers 22 and 23 form viscoelastic layers of a constrained layer damping system. In other embodiments, and as explained in further detail below, a sole structure may have more or fewer layers and/or such layers may have different configurations.

Each of spring plates 11, 12 and 13 is generally incompressible, relatively thin, and elastically flexible. Spring plates 11, 12 and 13 provide structural support for sole structure 10 and anatomical support for a wearer foot. In particular, plates 11, 12, and 13 help sole structure 10 to maintain its shape and limit the amount that sole structure 10 deforms in response to forces imposed by running, jumping and other movements of a shoe wearer. When plates 11, 12 and 13 bend or otherwise deform in response to forces imposed by the wearer foot, the energy is stored by the deformed plates. To the extent that energy is not absorbed by the damping material layers or otherwise, it is returned as a force on the wearer foot as the deforming forces are eased. This helps to reduce wearer fatigue while at the same time cushioning the wearer foot from the effects of reactive impact forces. In some embodiments, spring plates 11, 12 and 13 can be formed from flexible high-strength materials such as thermoplastics and thermoplastic composites (e.g., composites of thermoplastic resin with embedded carbon, glass and/or other types of fibers).

Each of damping material layers 21, 22 and 23 is viscoelastic and at least partially compressible in response to forces imposed by a wearer foot. This compression further dampens reactive forces on the foot and helps to further cushion the wearer foot from impact shocks during running, side-to-side cutting, and other types of maneuvers. The alternating arrangement of spring plates 11, 12 and 13 and damping material layers 21, 22 and 23 further allows sole structure 10 to benefit from increased cushioning of multiple damping material layers while avoiding instability that might occur from excessive sole structure deformation. In some embodiments, damping material layers 21, 22 and 23 can be formed from any of various types of foam materials or combinations of foam materials. Examples of such materials can include foamed EVA (ethylene vinyl acetate) and foam materials used in the LUNAR family of footwear products available from NIKE, Inc. of Beaverton, Oreg. Additional examples of foam materials that can be used for damping material layers 21, 22 and 23 include materials described in U.S. Pat. No. 7,941,938, which patent is hereby incorporated by reference herein.

Figure 2B:
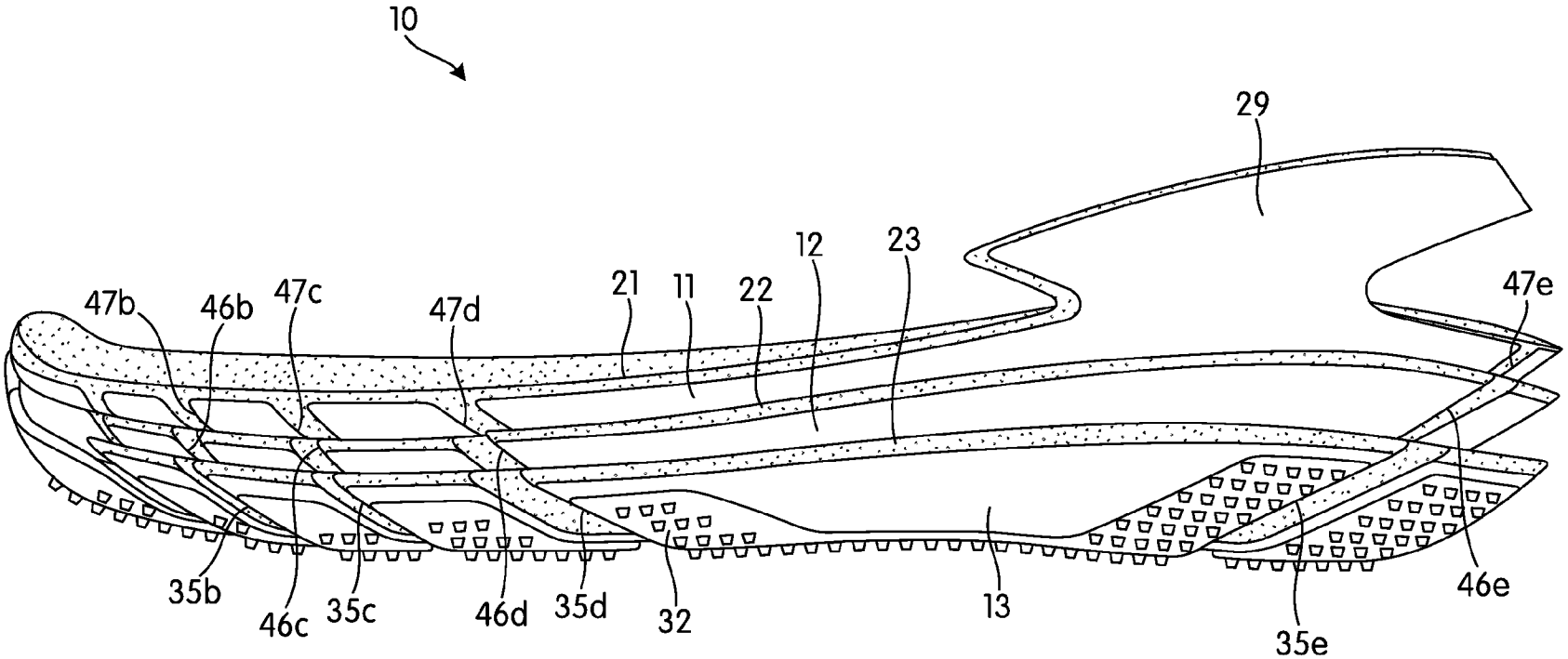
Figure 2C:
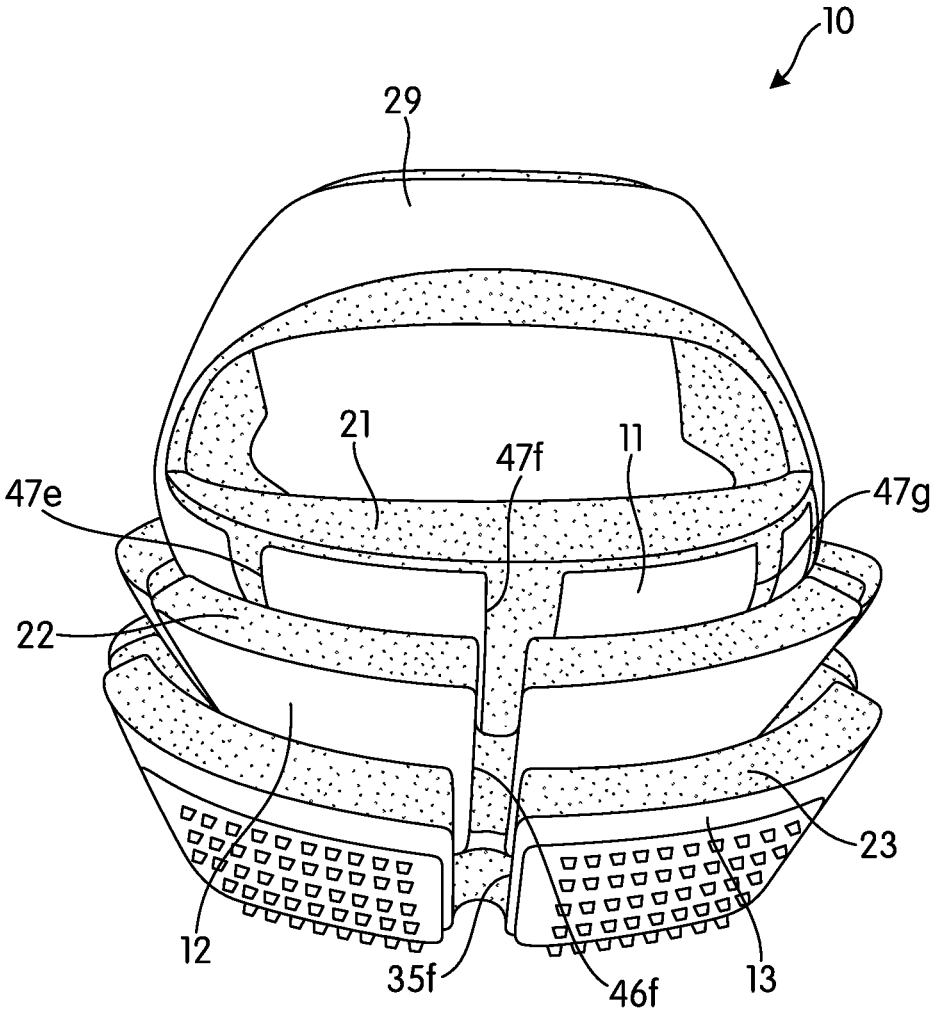
Figure 2D:
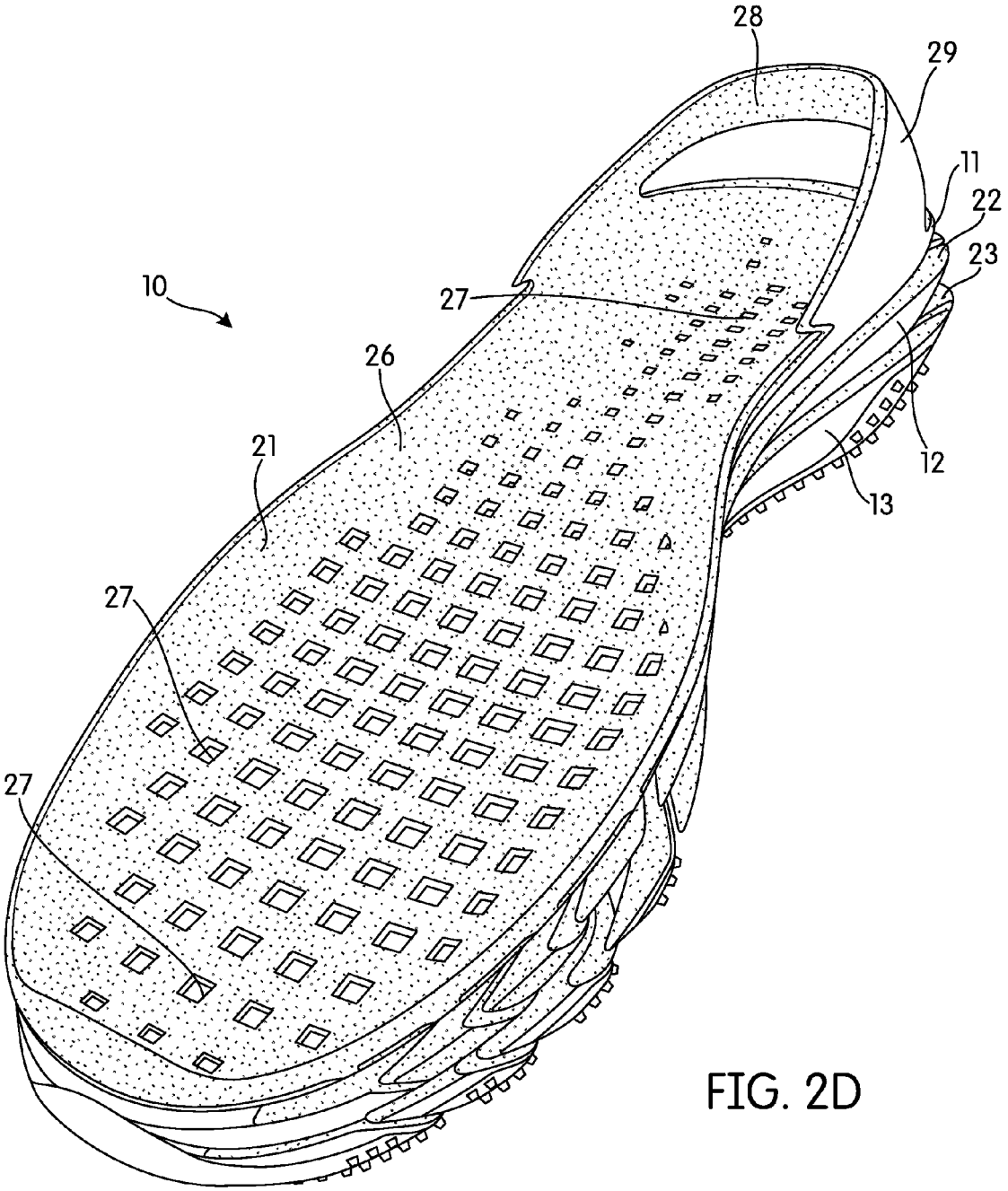

In the embodiment of sole structure 10, and referring to FIG. 2D, an interior face 26 of first damping material layer 21 is bonded to the bottom and lower outer edges of upper 2. The damping material of layer 21 may include perforations 27 to reduce weight. As explained in further detail below, such perforations or other damping material gaps may also be included to modify properties of a damping material layer. Layer 21 further includes an extension 28 that covers an interior face of a heel counter 29 formed as part of first spring plate 11. An exterior face (not shown) of first damping material layer 21 is bonded to an interior face (also not shown) of first spring plate 11. First spring plate 11 is partially nested within second spring plate 12, which in turn is partially nested within third spring plate 13. Second damping material layer 22 rests between first spring plate 11 and second spring plate 12. As explained in further detail below, second damping material layer 22 does not extend throughout the entire overlapping area of first and second spring 11 and 12. Third damping material layer 23 rests between second spring plate 12 and third spring plate 13. Third damping material layer 23 similarly does not extend throughout the entire overlapping area of second and third spring plates 12 and 13.

Figure 2E:
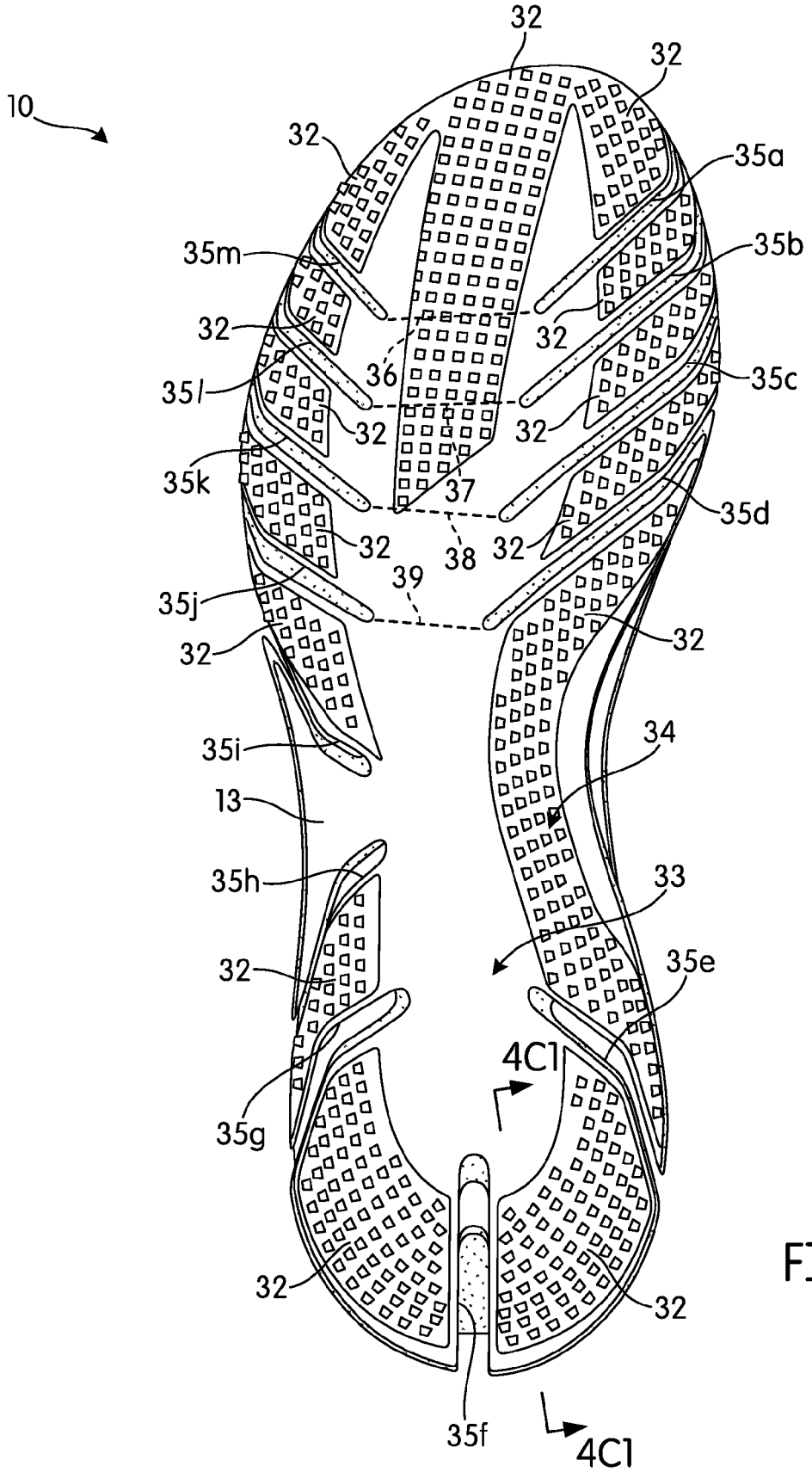

As seen in FIG. 2E, one or more outsole elements 32 may be bonded to an exterior surface of third spring plate 13. Outsole elements 32, which may be formed from synthetic rubber or other elastomeric materials, help to increase traction. Elements 32 also help reduce abrasion and other damage to spring plate 13 that might result from direct contact with the ground. Lugs, treads or other surface features can be formed in outsole elements 32 to further increase traction.

As also seen in FIG. 2E, third spring plate 13 includes a raised central portion 33 surrounded by a trough 34. Because sole structure 10 is inverted in FIG. 2E, central portion 33 appears as a depression and trough 34 appears as a ridge surrounding that depression. Trough 34 may be largest in heel and midfoot regions of sole structure 10 and may be almost entirely absent in forefoot regions of sole structure 10. As explained in more detail below in connection with FIG. 5, trough 34 and central portion 33 act as a spring structure that deforms under loads induced by running or other activity. Second spring plate 12 also includes a trough and raised region similar to trough 34 and raised region 33 of third spring plate 13.

Third spring plate 13 includes channels 35*a* through 35*m*. Similar channels can be formed in regions of second spring plate 12 corresponding to (or slightly offset from) the regions of third spring plate in which channels 35*a* through 35*m* are located, as well as in regions of first spring plate 11. Portions of second damping material layer 22 and third damping material layer 23 also include corresponding channels. In some embodiments, first damping material layer 21 may also include channels. Channels 35*a* through 35*m*, together with corresponding channels in other layers of sole structure 10, allow sole structure 10 to flex in response to normal foot motions. For example, as a wearer foot dorsiflexes during walking or running, the forefoot portion of third spring plate 13 is able to more easily bend along lines 36, 37, 38 and 39 that respectively span the inboard ends of channels 35*a* and 35*m*, channels 35*b* and 35*l*, channels 35*c* and 35*k* and channels 35*d* and 35*j*. Corresponding channels in spring plates 12 and 11 similarly allow those plates to bend in locations corresponding to lines 36 through 39.

Figure 3A:
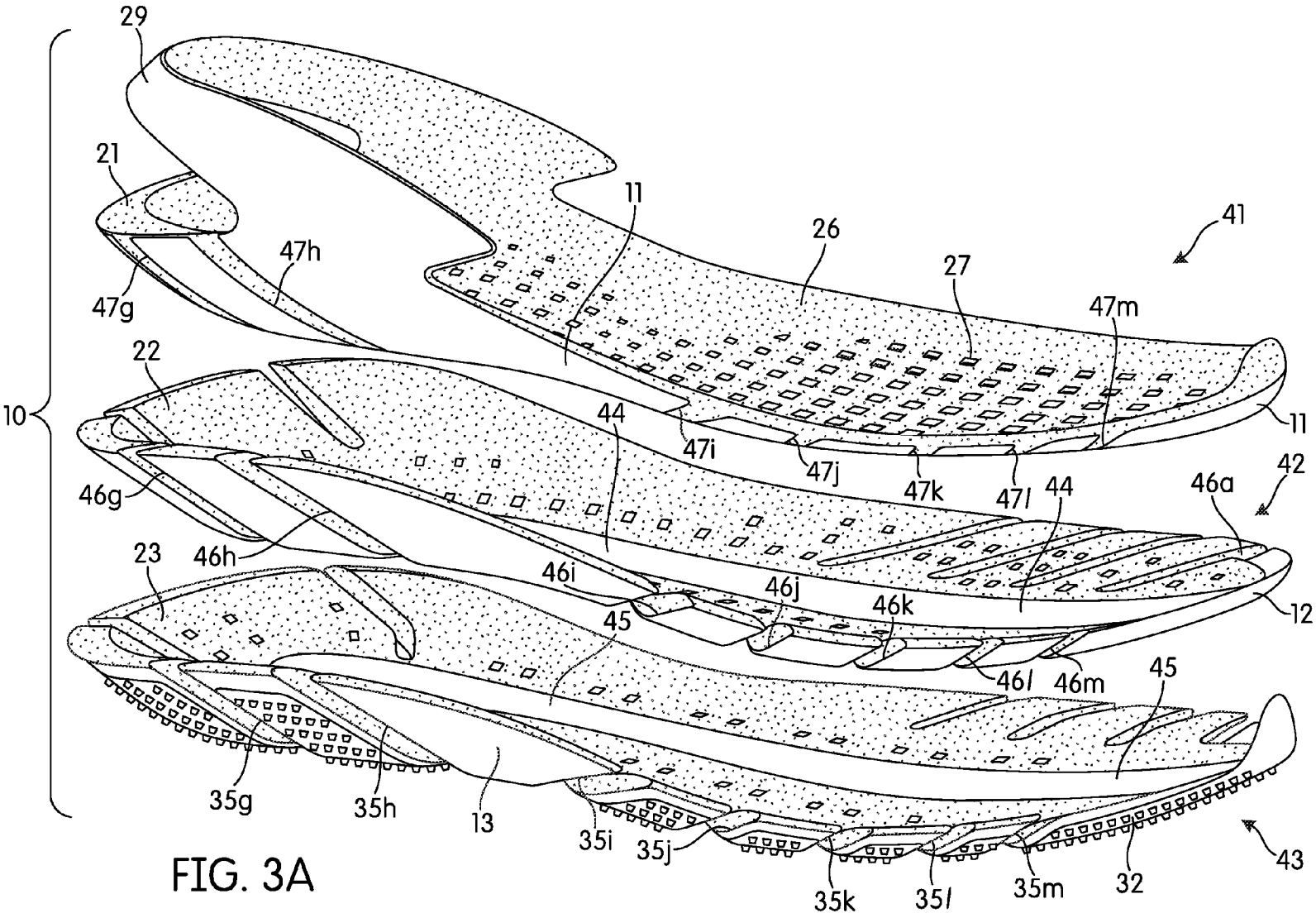
FIG. 3A is partially exploded, top lateral perspective view of the sole structure from the shoe shown in FIG. 1.
Figure 3B:
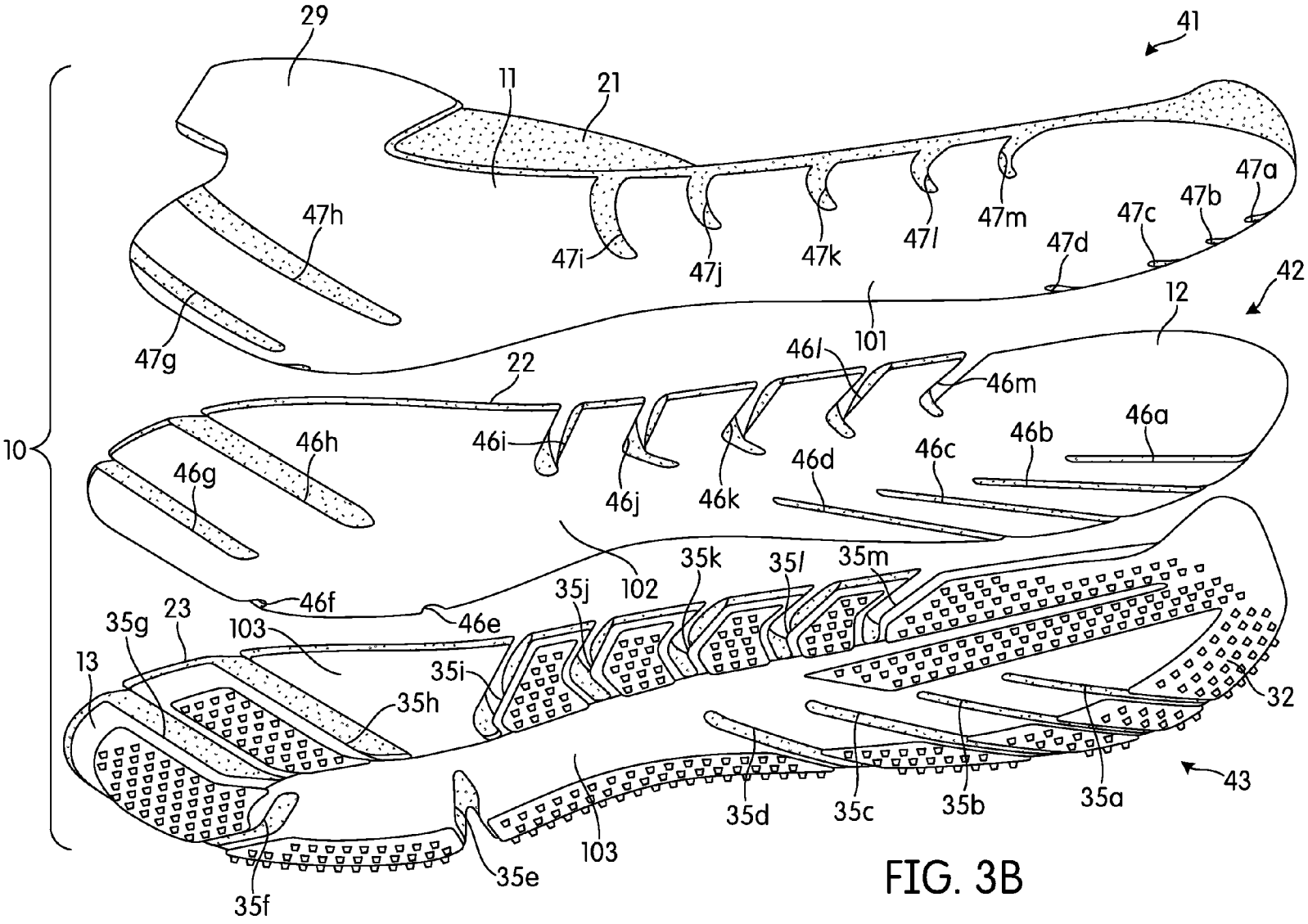
FIG. 3B is a partially exploded, bottom lateral perspective view of the sole structure from the shoe shown in FIG. 1.

FIG. 3A is partially exploded, top lateral perspective view of sole structure 10. FIG. 3B is a partially exploded, bottom lateral perspective view of sole structure 10. First damping layer 21 is bonded to first spring plate 11 so as to form a first macrolayer 41. Second damping layer 22 is bonded to second spring plate 12 so as to form a second macrolayer 42. Third damping layer 23 is bonded to third spring plate 13 so as to form a third macrolayer 43. As explained in further detail below, macrolayers 41, 42 and 43 are joined together by bonding the interior face of macrolayer 43 to the exterior face of macrolayer 42 and by bonding the interior face of macrolayer 42 to the exterior face of macrolayer 41.

Unlike damping material layer 21, which covers most of the entire interior face of spring plate 11, second and third damping material layers 22 and 23 respectively cover less than all of the interior faces of second and third spring plates 12 and 13. An interior face of a longitudinally extending attachment portion, or central strip 44 of second spring plate 12 is exposed. Second damping material layer 22 covers substantially all of the interior face of second spring plate 12 in regions surrounding central strip 44. As explained in more detail below, central strip 44 is directly bonded to a corresponding portion of first spring plate 11. A small portion of the second spring plate 12 interior face in the front most forefoot region, not clearly visible in FIG. 3A, may also be exposed.

The interior face of third spring plate 13 similarly includes an exposed, longitudinally extending central strip 45. Central strip 45 is not covered by third damping material layer 23. However, damping material layer 23 does cover substantially all of the interior face of third spring plate 13 in regions surrounding central strip 45. As explained in more detail below, central strip 45 is directly bonded to a corresponding portion of second spring plate 12. A small portion of the third spring plate 13 interior face in the front most forefoot region, also not clearly visible in FIG. 3A, may not be covered by third damping material layer 23.

FIGS. 3A and 3B further show the previously-mentioned channels that correspond to channels 35*a*-35*m* of third spring plate 13. For example, channels 46*a* through 46*m* of second spring plate 12 respectively correspond to channels 35*a* through 35*m* of third spring plate 13. Similarly, channels 47*a* through 47*d* and 47*g* through 47*m* of first spring plate 11 respectively correspond to channels 46*a* through 46*d* and 46*g* through 46*m* of second spring plate 12 and to channels 35*a* through 35*d* and 35*g* through 35*m* of third spring plate 13. Additional channels in first spring plate 11, not visible in FIGS. 3A and 3B, correspond to channels 46*e* and 46*f* and to channels 35*e* and 35*f*. Channels in third damping material layer 23 and in second damping material layer 22, portions of which are visible in FIGS. 3A and 3B, similarly correspond to channels 35*a* through 35*m* and to channels 46*a* through 46*m*. Damping material layers 22 and 23 may also include perforations similar to perforations 27.

FIG. 4A1 is an enlarged, partially schematic, area cross-sectional view of shoe 1 from the location indicated in FIG. 1. So as to avoid obscuring details that will be described in connection with FIG. 4A1, the locations of channels 35 in third spring plate 13, channels 46 in second spring plate 12, and channels 47 in first spring plate 11 are not shown. Similarly, channels and perforations are not shown in first damping material layer 21, second damping material layer 22 or third damping material layer 23. FIG. 4A2 is similar to FIG. 4A1, but has been partially exploded in a manner similar to that of FIGS. 3A and 3B. Upper 2, outsole elements 32 and counter 29 have been omitted from FIG. 4A2, so as to only show macrolayers 41, 42 and 43.

As indicated in FIG. 4A2, central strip 45 of third spring plate 13 is located at the apex of raised central portion 33. A medial span 52 of third spring plate 13 extends transversely from central strip 45. Medial span 52 includes a downwardly sloping inner medial span 53 closest to central strip 45 and a more horizontal outer medial span 54. A medial outer edge 55 of third spring plate 13 extends upward from outer medial span 54. Third spring plate 13 further includes a lateral span 56 having a downwardly sloping inner lateral span 57 and a more horizontal outer lateral span 58, as well as a lateral outer edge 59 that extends upward from outer lateral span 58.

As can be readily inferred from FIGS. 2A and 2B, as well as from other drawing figures, central strip 45, medial span 52, medial outer edge 55, lateral span 56 and lateral outer edge 59 of third spring plate 13 extend along the longitudinal length of sole structure 10. In particular, each of medial span 52, medial outer edge 55, lateral span 56 and lateral outer edge 59 includes portions located in heel, midfoot and forefoot regions of third spring plate 13. However, the shapes and sizes of medial span 52, medial outer edge 55, lateral span 56 and lateral outer edge 59 vary along the longitudinal length of third spring plate 13.

An example of this variation is further shown in FIGS. 4B1 and 4B2. FIG. 4B1 is an enlarged, partially schematic, area cross-sectional view of shoe 1 from the location indicated in FIG. 1. As with FIGS. 4A1 and 4A2, spring plate channels, damping layer channels and damping layer perforations are not shown in FIGS. 4B1 and 4B2 to avoid confusing these figures with unneeded detail. Similarly, upper 2 and outsole elements 32 have been omitted from FIG. 4B2. Unlike FIGS. 4A1 and 4A2, which show heel region cross sectional views, FIGS. 4B1 and 4B2 show forefoot region cross sectional views. In the forefoot region, trough 34 is shallower and raised central portion 33 is shorter. Medial span 52 and lateral span 56 are wider so as to accommodate the wearer forefoot. Medial inner span 53 and lateral inner span 57 have less downward slope. Medial outer edge 55 and lateral outer edge 59 each has a shorter upward extent.

Returning to FIG. 4A2, second spring plate 12 includes a central strip 44, a downwardly sloping medial span 62, a medial outer edge 63 extending upward from medial span 62, a downwardly sloping lateral span 64, and a lateral outer edge 65 extending upward from lateral span 64. First spring plate 11 includes an upwardly curving medial span 68, a medial outer edge 69 extending upward from medial span 68, an upwardly curving lateral span 70, and a lateral outer edge 71 extending upward from lateral span 70. Each of central strip 44, medial spans 62 and 68, lateral spans 64 and 70, medial outer edges 63 and 69, and lateral outer edges 65 and 71 extend along the longitudinal length of sole structure 10 and include portions located in heel, midfoot and forefoot regions. The shapes and sizes of these features also vary along the length of sole structure 10. This variation can be seen in FIGS. 4B1 and 4B2 and generally throughout the drawings.

FIG. 4C1 is an enlarged, partially schematic, area cross-sectional view of shoe 1 from the location indicated in FIG. 2E. FIG. 4C1 has also been rotated 90° clockwise from the orientation indicated by FIG. 2E. As with FIGS. 4A1 through 4B2, damping layer perforations are not shown in FIGS. 4C1 and 4C2. As with FIG. 4A2, upper 2, outsole elements 32 and counter 29 have been omitted from FIG. 4C2.

Third spring plate 13 further includes a heel span 76 extending rearward from central strip 45. Heel span 76 includes a downwardly sloping inner heel span 77 closest to central strip 45 and a more horizontal outer heel span 78. A heel outer edge 79 of third spring plate 13 extends upward from outer heel span 78. Heel span 76 wraps around the heel region of third spring plate 13 from the rear of medial span 52 to the rear of lateral span 56. Heel outer edge 79 similarly wraps around the heel region of third spring plate 13 from the rear of medial outer edge 55 to the rear of lateral outer edge 59. Second spring plate 12 includes heel span 83 (which wraps around the heel region of second spring plate 12 from the rear of medial span 62 to the rear of lateral span 64) and heel outer edge 84 (which wraps around the heel region of second spring plate 12 from the rear of medial outer edge 63 to the rear of lateral outer edge 65). First spring plate 11 includes heel span 87 (which wraps around the heel region of first spring plate 11 from the rear of medial span 68 to the rear of lateral span 70) and heel outer edge 88 (which wraps around the heel region of first spring plate 11 from the rear of medial outer edge 69 to the rear of lateral outer edge 71).

As previously indicated, first damping material layer 21 is bonded to, and covers the entire interior face of, first spring element 11. As a result, and as seen in FIGS. 3A and 3B, first macrolayer 41 includes an interior surface that is substantially covered by damping material. Until first macrolayer 41 is attached to other components of sole structure 10 (e.g., upper 2 and second macrolayer 42), first spring plate 11 is exposed over an entire exterior surface 101.

The entire interior surface of second spring plate 12 is not covered by second damping material layer 22. Instead, second damping material layer 22 includes portions bonded to the interior faces of medial span 62, heel span 83, lateral span 64, medial outer edge 63, heel outer edge 84 and lateral outer edge 65. Until second macrolayer 42 is attached to other components of sole structure 10 (e.g., first macrolayer 41 and third macrolayer 43), the interior surface of second macrolayer 42 exposes second spring plate 12 along central strip 44 and an exterior surface of second macrolayer 42 exposes the exterior surface 102 of second spring plate 12 over its entire area.

Similarly, the entire interior surface of third spring plate 13 is not covered by third damping material layer 23. Third damping material layer 23 includes portions bonded to the interior faces of medial span 52, heel span 76, lateral span 56, medial outer edge 55, heel outer edge 79 and lateral outer edge 59. Until third macrolayer 43 is attached to other components of sole structure 10 (e.g., second macrolayer 42 and outsole elements 32), the interior surface of third macrolayer 43 exposes third spring plate 13 along central strip 45 and the exterior surface of macrolayer 43 exposes the exterior surface 103 third spring plate 13 over its entire area.

The interior surface of second macrolayer 42 is bonded to the exterior surface of first macrolayer 41. As a result, central strip 44 is bonded directly to a corresponding portion of exterior surface 101. The interior surface of second damping material layer 22 is bonded to another portion of exterior surface 101 of first spring plate 11. Third macrolayer 43 is bonded directly to the exterior surface of second macrolayer 42. As a result, central strip 45 is bonded directly to a portion of exterior surface 102 of second spring plate 12. The interior surface of third damping material layer 23 is bonded to another portion of exterior surface 102.

Figure 5:
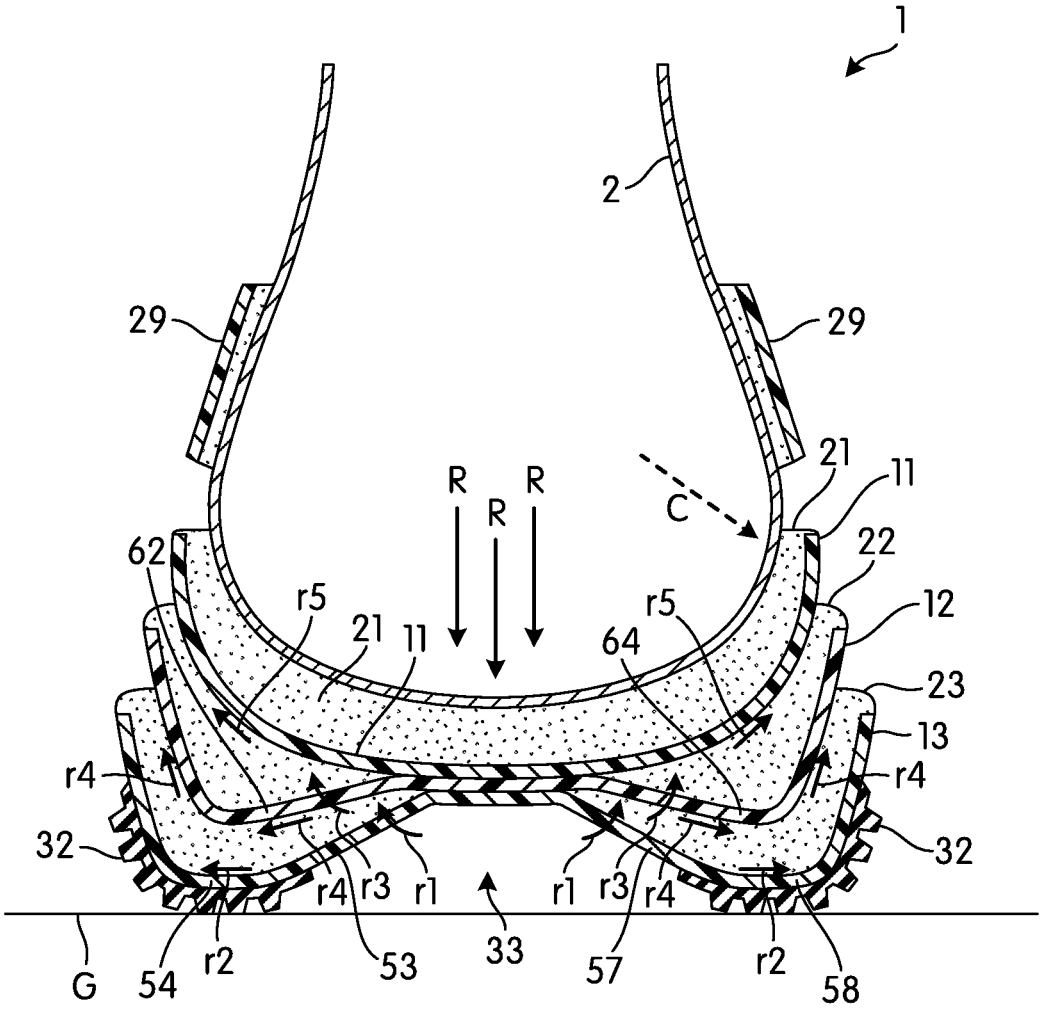
FIG. 5 is a cross-sectional view similar to FIG. 4A1.

One example of advantages of sole structure 10 can be understood by reference to FIG. 5, a cross-sectional view similar to FIG. 4A1. In FIG. 5, arrows R indicate force that could be applied by a wearer foot during running. As the wearer foot pushes in the directions of arrows R, central strip 45 is pushed toward the ground G. This tends to rotate inner medial span 53 and inner lateral span 57 toward the wearer foot, as indicated by arrows r1. Although not shown in FIG. 5, inner heel span 77 would similarly be rotated upward. At the same time, outer medial span 54, outer lateral span 58 and outer heel span 78 (not shown in FIG. 5) would be pushed outward (arrows r2). Medial span 62, lateral span 64 and heel span 83 of spring plate 12 (not shown in FIG. 5) would also rotate upward as indicated by arrows r3. Second spring plate 12 moves relative to third spring plate 13 in a shearing direction. This causes a shear in damping material layer 23, as shown by arrows r4. First spring plate 11 moves relative to second spring plate 12, causing a shear in damping material layer 22 (arrows r5). As a result of this shear motion transferred to damping material layers 22 and 23, a portion of the mechanical energy generated by the ground impact of the shoe 1 sole structure is absorbed.

Additional advantages are provided by upwardly extending outer edges of spring plates 11, 12 and 13, as well as by the presence of damping material between those outer edges. Additional area is provided for shear motion between spring plates, thus allowing more absorption of mechanical energy during ground impact. The nested configuration of the spring plates also helps to stabilize sole structure 10. The upwardly extending portions of the outer edges provide additional support to a wearer foot. For example, a wearer foot might push harder to the outside (arrow C) during a cutting maneuver. In such a case, lateral outer edges 71, 65 and 59 of first spring plate 11, second spring plate 12 and third spring plate 13, respectively, would resist that force. The damping material of layers 23 and 22 would help reduce shock on the foot during a cutting motion or other side-to-side movement. For example, a portion of damping material layer 22 between lateral outer edges 65 and 71 (spring plates 12 and 11, respectively) and between lateral outer edges 59 and 65 (spring plates 13 and 12, respectively) would be compressed in response to force in the direction of arrow C. At the same time, a portion of damping material layer 22 between medial outer edges 63 and 69 (spring plates 12 and 11, respectively) and between medial outer edges 55 and 63 (spring plates 13 and 12, respectively) would be pulled in tension in response to force in the direction of arrow C. The viscoelastic compression and tension of these portions of layers 22 and 23 helps to absorb shock from sideways force C.

As previously indicated, sole structure 10 includes a counter 29. As seen in FIGS. 1 through 2D, 3A and 3B, counter 29 is formed as an integral component of first spring plate 11. In particular, a lateral side of counter 29 is integrally formed as an extension of the top edge of lateral outer edge 71. Similarly, a medial side of counter 29 is integrally formed as an extension of the top edge of medial outer edge 69. The interior surface of counter 29 is covered by and bonded to a damping material cushion 28 that is an integral portion of first damping material layer 21.

Counter 29 provides additional support for a wearer foot and helps to stabilize the wearer foot relative to sole structure 10. Including counter 29 as a part of sole structure 10 may simplify fabrication of upper 2 by avoiding the need to include a conventional counter as part of upper 2. In other embodiments, counter 29 may have a different shape. Some embodiments may not include a counter as part of a sole structure.

Figure 6A:
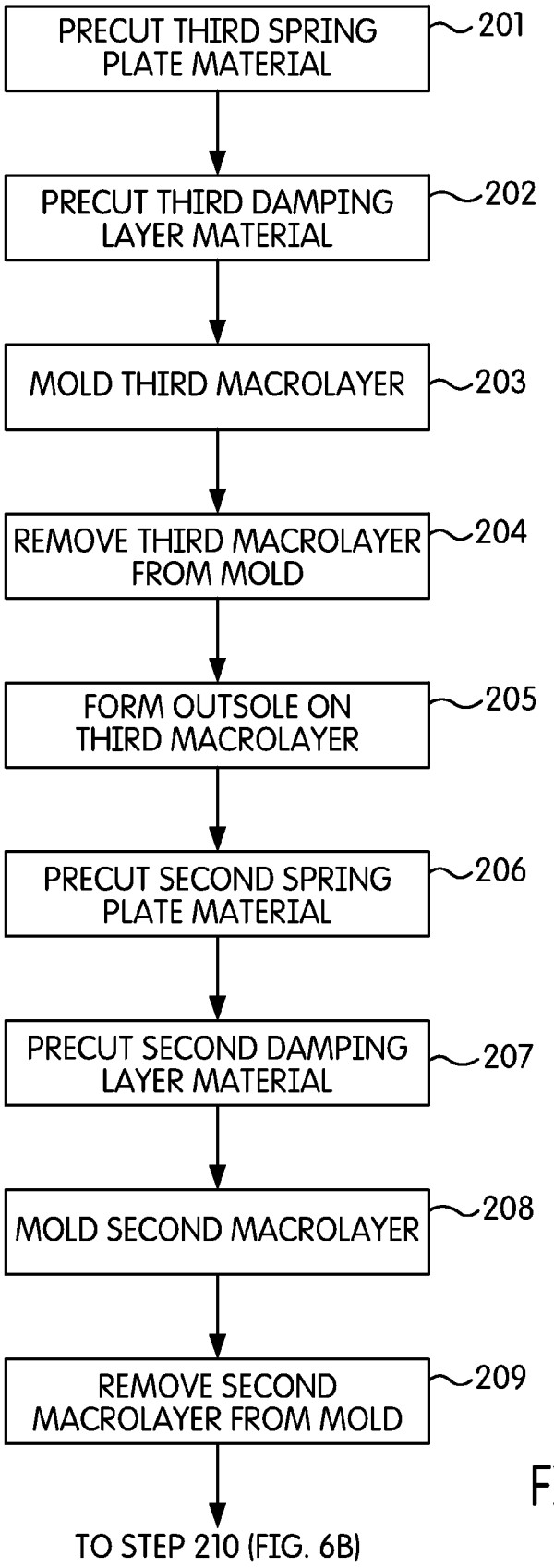
FIGS. 6A and 6B are a block diagram that outlines steps to produce a sole structure according to at least some embodiments.
Figure 6B:
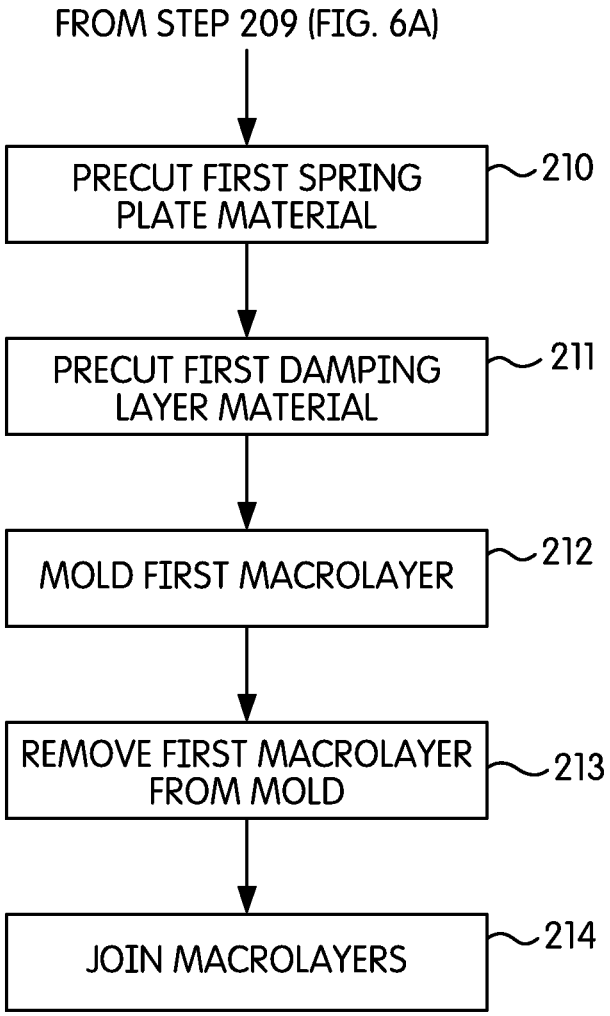

Various techniques can be used to manufacture sole structure 10. FIGS. 6A and 6B are a block diagram that outlines steps to produce sole structure 10 according to some embodiments. Formation of third macrolayer 43 begins in step 201. In some embodiments, a macrolayer is formed by simultaneously hot pressing sheets of raw spring plate material and raw damping layer material into the proper shape. The sheet of raw spring plate material could comprise a mat woven from a mixture of reinforcing fibers and thermoplastic fibers. The sheet of raw damping layer material could comprise foam material sheet stock. The sheet stock could include a blowing agent that causes bubbles to form (and thus foam to be created) when the sheet stock is heated.

The raw spring plate material sheet may be precut before pressing. In particular, and as generally indicated at step 201, the sheet may be cut to a shape that corresponds to a flattened version of the third spring plate and which, after pressing, will have the proper shape. Openings for channels 35*a* through 35*m* can be precut. The raw damping material sheet could also be precut in a similar manner (step 202). For example, that sheet could be precut to include perforations similar to perforations 27, channels that will correspond to channels 35*a* through 35*m*, and an opening that will expose central strip 45.

In step 203, the precut sheets from steps 201 and 202 may be placed into an open and heated third macrolayer compression mold. That mold, when closed, may form a mold volume having the shape of the third macrolayer. The third macrolayer mold may then be closed and force applied to compress the mold elements together. In some embodiments, step 203 may further include withdrawing air from the mold during the pressing so that a vacuum is formed. After the appropriate cure time for the types of materials being used, the mold may be opened and the third macrolayer removed (step 204).

After forming third macrolayer 43, outsole elements 32 can be applied (step 205). In some embodiments, elements 32 can be applied using an outsole mold assembly having one or more surfaces corresponding to elements 32. One or more sheets of material that will form elements 32 can be placed into the outsole mold and over the outsole-forming surface(s). Third macrolayer 43 may then be placed into the outsole mold with the exterior face in contact with the element 32 material. The outsole mold can then be closed and elements 32 simultaneously formed and bonded to exterior surface 103 of third spring plate 13. At the conclusion of step 205, third macrolayer 43 with attached outsole elements 32 can be removed from the outsole mold.

Second macro layer 42 is formed in steps 206 through 209 in a manner similar to that of steps 201 through 204. In steps 206 and 207, sheets of raw spring layer material and raw damping material are cut to the proper shapes. In step 208, the precut sheets from steps 206 and 207 may be placed into an open and heated second macrolayer compression mold. That mold, when closed, may form a mold volume having the shape of second macrolayer 42. The second macrolayer mold may then be closed and force applied to compress the mold elements together. In some embodiments, step 208 may further include withdrawing air from the mold during the pressing so that a vacuum is formed. After the appropriate cure time, the mold may be opened and second macrolayer 42 removed (step 209).

First macro layer 41 is formed in steps 210 through 213 in a manner similar to that of steps 201 through 204 and steps 206 through 209. In step 210, a sheet of raw spring layer material may be precut. In some embodiments, that sheet may be precut so that one end of the material portion that will form counter 29 is attached and another end is free. When the sheet is placed into a mold, the free end could be manually wrapped around a mandrel and placed into the proper position on the sheet. In other embodiments, the spring layer material sheet may be cut so that both ends of counter 29 are attached. In step 211, a sheet of raw damping material is precut. The portion of that sheet that will be form the damping material 28 attached to counter 29 may or may not be attached at both ends. In step 212, the precut sheets from steps 210 and 211 may be placed into the open and heated first macrolayer compression mold having a mold volume corresponding to the shape of macrolayer 41 and integral counter 29. The mold may then be closed and force applied to compress the mold elements together. In some embodiments, step 212 may further include withdrawing air from the mold during the pressing so that a vacuum is formed. After the appropriate cure time, the mold may be opened and first macrolayer 41 removed (step 213).

In step 214, first macrolayer 41, second macrolayer 42 and third macrolayer 43 can be joined together. A glue or other bonding agent can be applied to the interior surface of third macrolayer 43 (and/or to the exterior surface of second macrolayer 42) and to the interior surface of second macrolayer 42 (and/or to the exterior surface of first macrolayer 41). The macrolayers can then be assembled into their nested configuration and pressed together until the bonding agent cures. After the bonding of step 214, sole structure 10 is formed. Sole structure 10 may then be glued or otherwise joined to upper 2 (e.g., while upper 2 is on a last).

The above steps need not be performed in the order listed. For example, first macrolayer 41, second macrolayer 42 and third macrolayer 43 can be formed in a different order or simultaneously. Numerous other variations are also possible. In some embodiments, for example, a spring plate may be first formed without a damping material layer attached. The formed spring plate could then be placed into a mold with one or more precut pieces of raw damping material in the appropriate locations and the mold closed and heated.

Other techniques could also be used. In some embodiments, for example, selective laser sintering (SLS) could be used. In some such embodiments, a spring plate could first be formed by pressing one or more sheets of spring plate material in a heated mold. SLS could then be used to form the damping material layer directly onto the appropriate regions of the spring plate interior face.

Sole structure 10 is merely one embodiment of a sole structure according to the invention. As indicated above, some embodiments may lack an integral counter such as counter 29. Other embodiments may differ from sole structure 10 in numerous other ways. Some embodiments may not include three macrolayers. In some embodiments, for example, a sole structure may only include two macrolayers. In other embodiments, a sole structure may include more than three macrolayers.

Macrolayers may also have configurations different from those of sole structure 10. In the embodiment of sole structure 10, each of macrolayers 41 through 43 includes a spring plate that extends over substantially the entire length and width of sole structure 10. This need not be the case, however. In some embodiments, for example, a spring plate may only extend throughout the heel region, may only extend throughout the heel and portions of the midfoot region, may only extend throughout the heel, midfoot and portions of the forefoot region, etc. For example, one embodiment may comprise a macrolayer having a spring plate that extends the entire length of the sole structure and another macrolayer having a spring plate that is only located in a heel region. As but another example, all of the macrolayers may be confined to a heel region. In some embodiments, a macrolayer may have a spring plate that is only located on one of a medial or lateral side, or that only has a reduced portion extending into one of a medial or lateral side. Damping material may cover more or less of a spring plate than is the case with macrolayers 41, 42 or 43.

The profiles of macrolayer spring plates may also vary in other embodiments. As but one example, outer edges of a spring plate may not extend upward as far as outer edges of spring plates in sole structure 10. As another example, outer edges may extend further than outer edges of spring plates in sole structure 10. In some embodiments, spring plate outer edges may not extend upward or may even extend downward. The height and/or width of a central portion and/or trough could vary. A structure of a spring plate on one side of a longitudinal centerline could be different from the structure of that spring plate on the other side of the longitudinal centerline. For instance, a spring plate could be thicker on one side or otherwise designed to increase or reduce flexibility on one side so as to compensate for overpronation.

Damping layer configurations could also vary widely in different embodiments. For example, some embodiments may include gaps in a damping material layer. Such gaps may be included so as to modify the properties of the damping material in a layer. The configurations of such gaps (e.g., shape, placement and/or number of gaps) can also be chosen so as to achieve a desired effect. The absence of damping material in one or more gaps may reduce the level of viscous response in region(s) associated with the gaps. Moreover, and depending on the fabrication method chosen, the wall surfaces of gaps may have a "skin" that is somewhat denser, harder, and/or less compressible than damping material beyond (inside) that skin. This "skin" may be formed at outer, exposed surfaces of a foam damping material, for example, by oxidation, by direct exposure of the damping material surfaces to curing conditions and/or curing agents (e.g., for a foam material), etc. Gaps could thus be selected so as to modify the overall properties of a damping material layer based on the presence of denser, harder, or less compressible skin regions associated with the damping material at the surfaces forming the gaps.

Figure 7A:
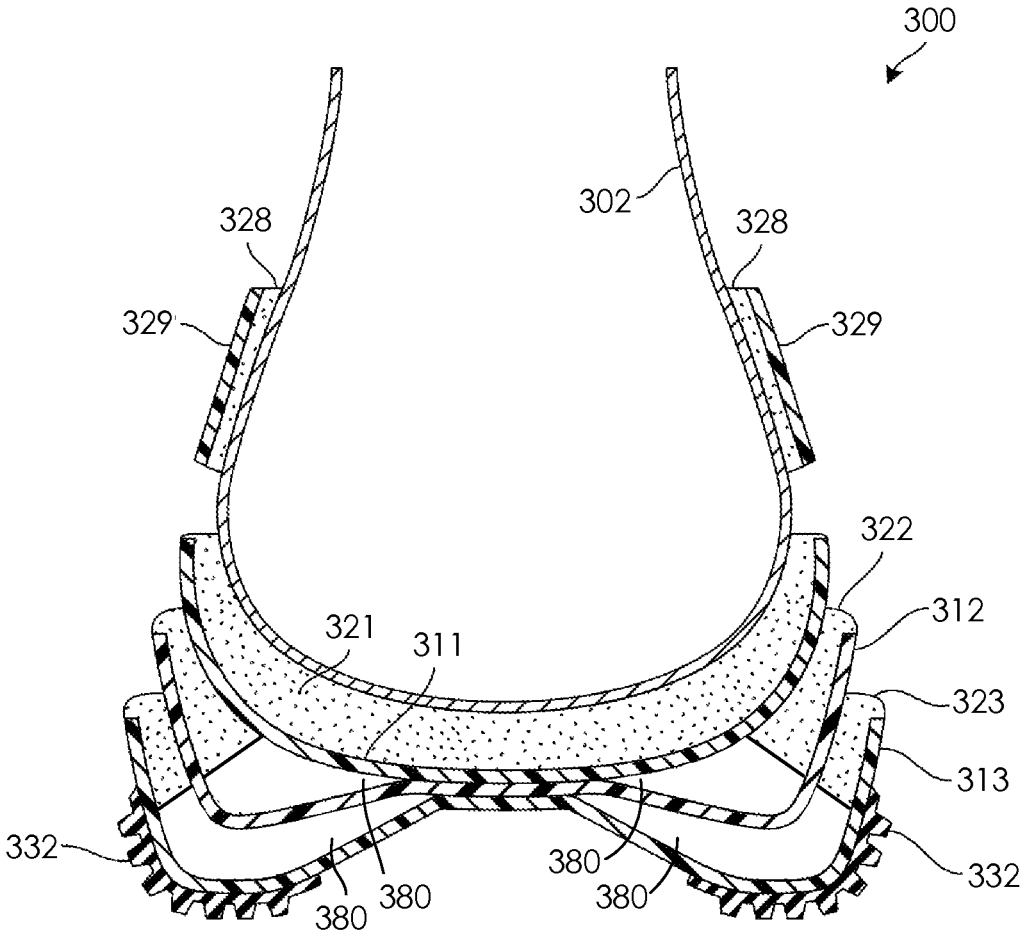
FIGS. 7A through 7D are partially schematic area cross-sectional views of shoes according to further embodiments.

As previously indicated in connection with FIG. 2D, some embodiments may include perforations 27 in first damping material layer 21. FIG. 7A is a partially schematic area cross-sectional view of a shoe 300 having damping material gaps according to another embodiment. The cross-section of FIG. 7A is taken from a heel area location similar to that from which the cross-sectional view of FIG. 4A1 is taken. Shoe 300 includes an upper 302 and a sole structure having spring plates 311 through 313, counter 329, cushion material 328, damping material layer 321 and outsole elements 332 that are respectively similar to upper 2, spring plates 11 through 13, counter 29, cushion material 28, damping material layer 21 and outsole elements 32 of shoe 1. Damping material layer 321 may or may not include perforations similar to perforations 27 of shoe 1.

Unlike damping material layers 22 and 23 of shoe 1, damping material layers 322 and 323 of shoe 300 have air gaps 380. Air gaps 380 may extend the length of the sole structure in some embodiments. In other embodiments, air gaps 380 may only be present in the heel region or in other selected regions. In still other embodiments, air gaps 380 may be significantly larger on the lateral or medial side, may only be present on the medial or lateral side, or may be more numerous on the medial or lateral side.

In some embodiments, one or more air gaps such as air gaps 380 might be at least partially occupied by a fluid-filled bladder. Such bladders may be tessellated or otherwise shaped so as to fit within spaces such as air gaps 380. One or more gaps similar to gaps 380, with or without bladders, could also be present in damping material layer 321.

Figure 7B:
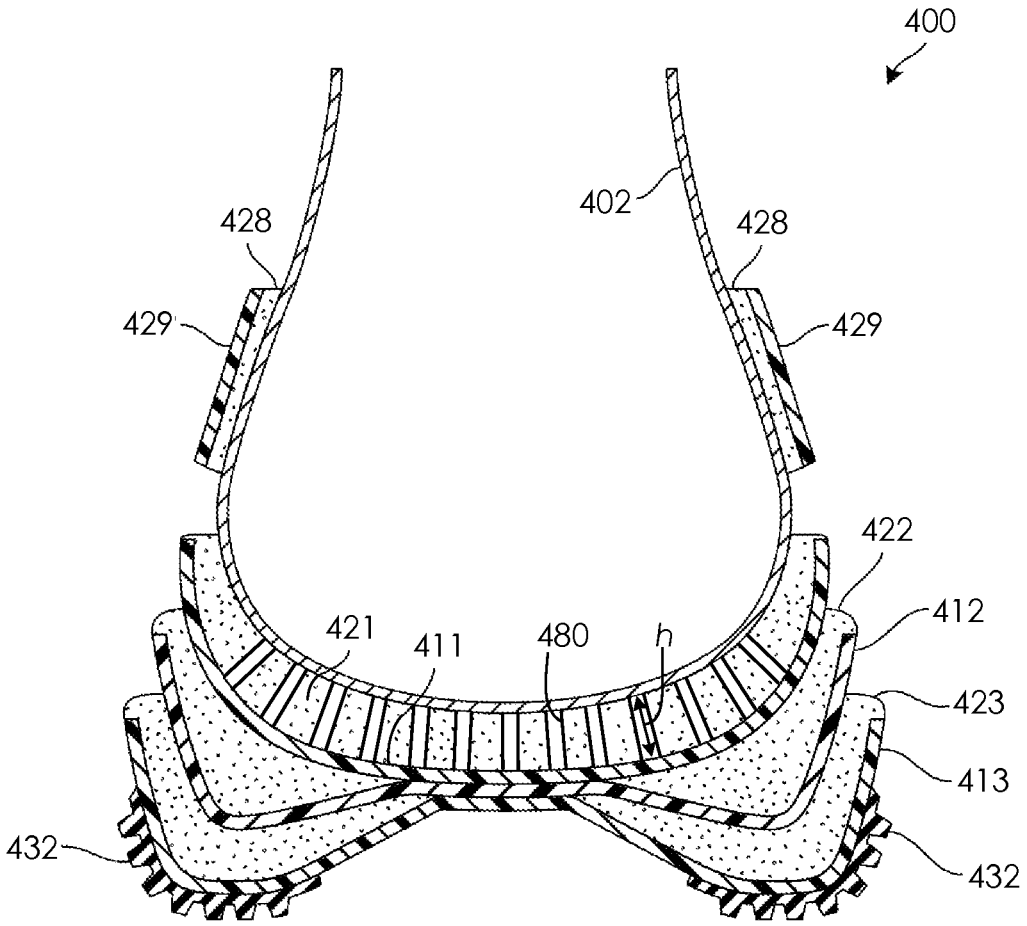

FIG. 7B is a partially schematic area cross-sectional view of a shoe 400 having damping material gaps according to a further embodiment. The cross-section of FIG. 7B is also taken from a heel area location similar to that from which the cross-sectional view of FIG. 4A1 is taken. Shoe 400 includes an upper 402 and a sole structure having spring plates 411 through 413, counter 429, cushion material 428, damping material layers 422 and 423, and outsole elements 432 that are respectively similar to upper 2, spring plates 11 through 13, counter 29, cushion material 28, damping material layers 22 and 23, and outsole elements 32 of shoe 1. Damping material layer 421 of shoe 400 includes gaps 480. Gaps 480 may be similar to perforations 27 in shoe 1 (including the "skin" feature mentioned above), but may be larger and/or have a different spacing or other configuration. The size, shape and spacing of gaps 480 may vary. As one example thereof, any of gaps 480 could be smaller and/or less (or more) numerous than perforations 27 in shoe 1. As another example, gaps 480 could have a cross-section (perpendicular to the height h of the gap) that is square, hexagonal, circular or of any other regular or irregular shape. The size and/or shape and/or distribution of gaps 480 may vary in the longitudinal and/or transverse directions (e.g., the number, spacing and/or shape of gaps 480 may differ on the medial and lateral sides and/or in the front and rear). Variations to the size, shape, spacing, number, skin density, skin hardness, and/or other features of the gaps 480 and/or materials at the gaps 480 may be used to control and/or fine tune characteristics of the "feel" of the sole structure (e.g., softness, comfort, compressibility, stiffness, responsiveness, etc.). As more specific examples, the presence or absence of gaps 480 may be used to provide a harder or softer feel for an overall layer and/or at localized areas of a layer (e.g., an uncored structure may feel softer to a wearer than the cored structure of FIG. 7B due to the absence of the gaps 480 (and/or the denser, harder, and/or less compressible "skin" features potentially associated with such gaps)).

Figure 7C:
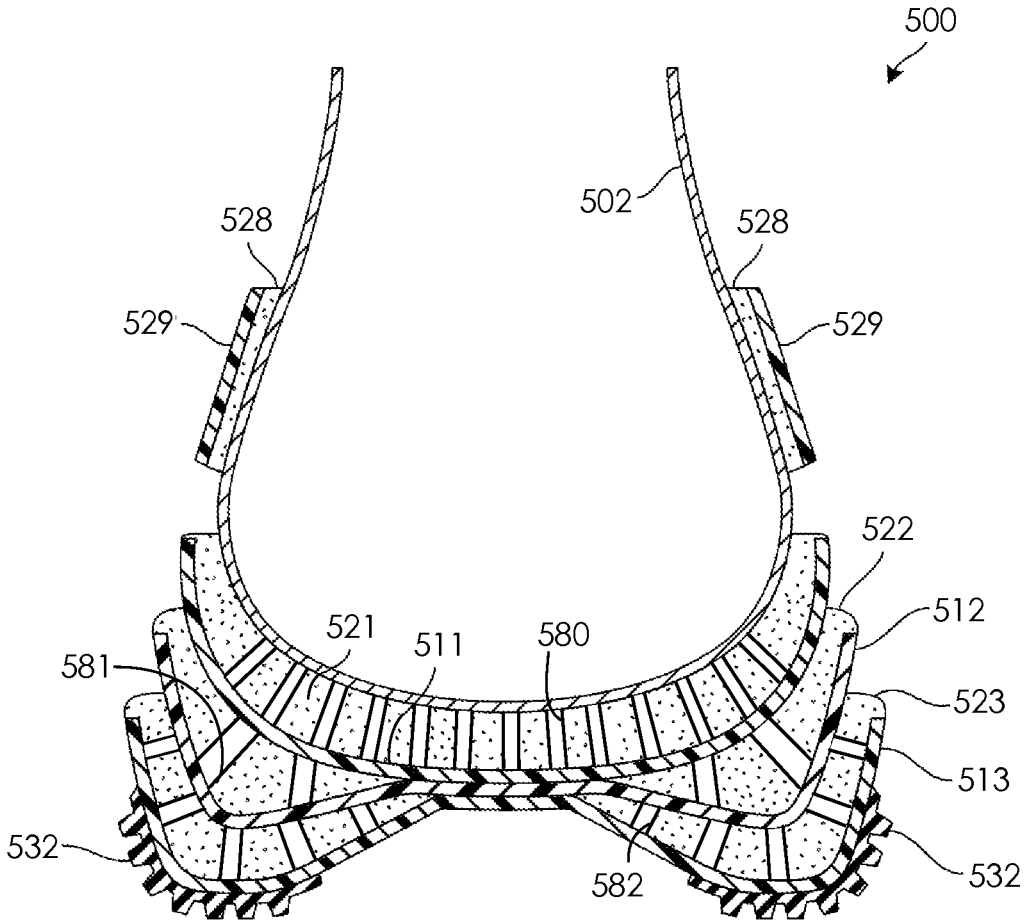

FIG. 7C is a partially schematic area cross-sectional view of a shoe 500 having damping material gaps according to a further embodiment. The cross-section of FIG. 7C is also taken from a heel area location similar to that from which the cross-sectional view of FIG. 4A1 is taken. Shoe 500 includes an upper 502 and a sole structure having spring plates 511 through 513, counter 529, cushion material 528, and outsole elements 532 that are respectively similar to upper 2, spring plates 11 through 13, counter 29, cushion material 28, and outsole elements 32 of shoe 1. Damping material layer 521 of shoe 500 is similar to damping material layer 421 of shoe 400 and includes gaps 580 similar to gaps 480. Damping material layer 522 of shoe 500 is similar to damping material layer 22 of shoe 1, but includes gaps 581. Damping material layer 523 of shoe 500 is similar to damping material layer 23 of shoe 1, but includes gaps 582. The size, shape and spacing of gaps 580-582 may vary. Any of gaps 580-582 could have a cross-section (perpendicular to its height) that is square, hexagonal, circular or of any other regular or irregular shape. The size and/or shape and/or distribution and/or other features of gaps 580-582 may vary in the longitudinal and/or transverse directions (and may be used to control and/or fine tune the "feel" and/or other characteristics of the sole structure as described above with respect to gaps 480).

Figure 7D:
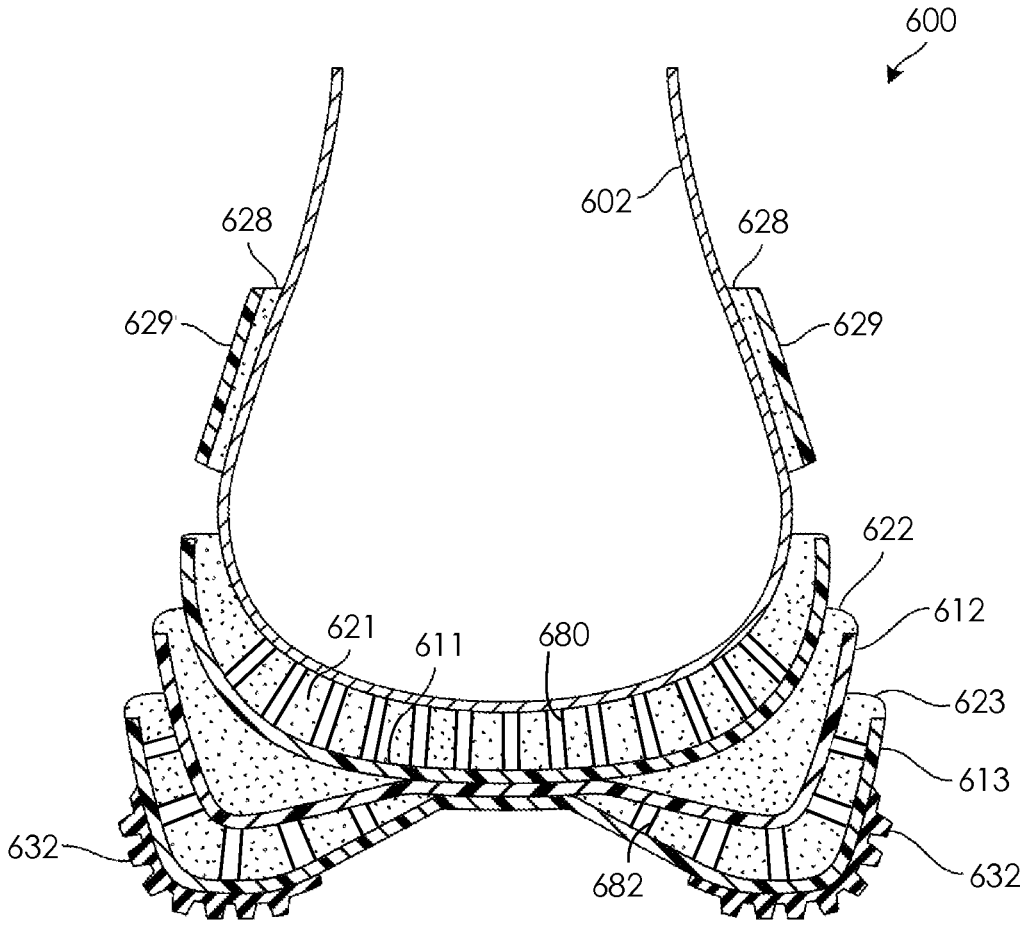

FIG. 7D is a partially schematic area cross-sectional view of a shoe 600 having damping material gaps according to a further embodiment. The cross-section of FIG. 7D is also taken from a heel area location similar to that from which the cross-sectional view of FIG. 4A1 is taken. Shoe 600 includes a sole structure having spring plates 611 through 613, counter 629, cushion material 628, and outsole elements 632 that are respectively similar to spring plates 11 through 13, counter 29, cushion material 28, and outsole elements 32 of shoe 1. Damping material layer 621 of shoe 600 is similar to damping material layer 521 of shoe 500 and includes gaps 680 similar to gaps 580. Damping material layer 623 of shoe 600 is similar to damping material layer 523 of shoe 500 and includes gaps 682 similar to gaps 582. The size, shape and spacing of gaps 680 and 683 may vary. Any of gaps 680 and 683 could have a cross-section (perpendicular to its height) that is square, hexagonal, circular or of any other regular or irregular shape. The size and/or shape and/or distribution and/or other features of gaps 680 and 683 may vary in the longitudinal and/or transverse directions (and may be used to control and/or fine tune the "feel" and/or other characteristics of the sole structure as described above with respect to gaps 480).

FIGS. 7A-7D merely represent some embodiments. In still further embodiments, for example, the first and second damping material layers may have gaps (e.g., similar to layers 521 and 522 of shoe 500), but a third layer may lack gaps (e.g., similar to layer 423 of shoe 400). As but another example, only the second or third layer includes gaps in certain embodiments. As further examples, gaps in one layer may be aligned with corresponding gaps in one or more other layers in some embodiments, while in other embodiments gaps in one layer may be offset from gaps in one or more other layers.

All macrolayers in a particular sole structure need not be formed from the same types spring plate material or from the same types of damping layer material. For example, one macrolayer of a sole structure could include a spring plate formed from a first composite and a first damping material, with another macrolayer of that sole structure including a spring plate formed from a second composite and second damping material. The first composite might be stiffer than the second composite, or vice versa. The first damping material might be softer than the second damping material, or vice versa. Similarly, a single macrolayer could include a spring plate formed from multiple materials and/or a damping material layer formed from multiple damping materials. For example, a spring plate could have reinforcing fibers (e.g., carbon, glass and/or polymer) in a heel and/or arch region to provide additional stiffness, or could have greater quantity of (or different type of) reinforcing fibers in a heel and/or arch region. As another example, a spring plate could be thicker in some regions (e.g., the heel and/or arch) where greater stiffness is desired. As a further example, a spring plate could be formed from one type (or mixture) of polymer resins in one region and from a different type (or mixture) of polymer resins in another region. The resin density might also vary throughout a spring plate. These features (e.g., varying reinforcement, thickness, resin content and/or density) and/or other features could also be combined within a single spring plate. Moreover, a spring plate in some embodiments may be stiffer or otherwise have different properties in regions other than a heel region. For example, and as previously indicated, a medial or lateral side could be made stiffer. A single damping material layer might also include multiple materials and/or otherwise vary in different regions of a sole structure. For example, a denser foam material might be used in regions where additional stiffness is needed. As another example, a less dense foam might be used in certain medial side regions to increase a "banked" feeling during cutting motions.

The configuration and/or number of macrolayers in sole structures according to various embodiments can be varied so as to obtain a sole structure tuned for a particular purpose (e.g., a particular sport). For example, some users might need less cushioning and prefer a shoe with a lower overall height. An embodiment intended for such users might only include two macrolayers. As another example, materials might varied and/or shapes varied so as to prevent overpronation or other undesirable foot motion. As a further example, bonding area between macrolayers without damping material (e.g., the width and/or length of regions such as central strips 44 and 45) could be increased or decreased so as to modify the stiffness of a sole structure. Materials and other configurations of one or more layers could be varied to accommodate persons of different weight. Materials and other configurations of one or more layers could also be varied to accommodate persons with unique styles of participating in an activity for which a shoe is intended. For example, one player might tend to have a "stomping" style of running. A shoe intended for such a player could have additional and/or stiffer layers in the heel regions. Another might tend to place more weight on his or her forefoot. A shoe intended for such a player might need less heel stiffness but need more support or cushioning in the forefoot.

In a manner similar to that in which multiple levels of constrained layer damping can be combined to dampen vibrations in selected frequency ranges, damping material layers and/or spring plates of different layers could also be selected so as to tune a sole structure to accommodate a certain range of activities. For example, a first damping material layer (e.g., similar to layer 21 of shoe 1) could be formed from a relatively soft material, a second damping material layer (e.g., similar to layer 22 of shoe 1) formed from a firmer material, and a third damping material layer (e.g., similar to layer 23 of shoe 1) formed from an even firmer material. The softer first layer could provide comfort to the wearer when engaged in relatively light activity such as casual walking. The firmer second layer could provide additional support when the wearer engages in more vigorous activity such as straight line running. The even firmer third layer could provide further support when the wearer engages in more demanding activity such as running with frequent cutting or other direction changes. In other embodiments, different combinations of damping material layers may be used so as to tune a sole structure for a desired range of activities.

Spring plates for various layers could alternatively (or also) be selected and/or varied to tune a sole structure in a similar manner. For example, one spring plate may be formed of a glass fiber composite and another spring plate may be formed from a carbon fiber composite, e.g., to provide different stiffness, flex, bend, and/or responsiveness characteristics. Spring plate thicknesses also could be varied (e.g., within a given layer and/or from layer-to-layer) to provide different characteristics, e.g., different stiffness, flex, bend, responsiveness, etc.).

Additionally or alternatively, features of the attachment (e.g., via adhesives or cements, via mechanical connectors, via fusing techniques, etc.) between the various layers of the sole structure may be varied (e.g., direct attachment between adjacent spring plates and/or between plates and adjacent damping material layers) to control or fine tune the "feel" and/or other characteristics of the sole structure. As some more specific examples, the amount of surface area creating the attachment(s), the location(s) of the attachment(s), and/or the type(s) of the attachment(s) may be varied or controlled to alter or tune the "feel" or other characteristics of the sole to the wearer. As yet additional examples, the surface area and/or locations of attachments between adjacent plates and/or between plates and adjacent damping material layers may be varied to control stiffness features of the sole structure (including torsional stiffness, linear stiffness); to control flex or bending of the sole structure; to control the torsion and/or flexibility of the forefoot area of the sole structure with respect to the heel area of the sole structure; to promote (or inhibit) pronation or supination; to control responsiveness of the sole structure; etc.

In some embodiments, additional connections between macrolayers could be added. As but one example thereof, spring plates of different macrolayers might be joined along portions of their outer edges so as to increase stiffness in certain regions. Spring plates of adjacent macrolayers might also lack direct connections to one another. Unlike the embodiment of sole structure 10, where central strip 45 is directly bonded to second spring plate 12 and central strip 44 is directly bonded to first spring plate 11, other embodiments may include a material interposed between two spring plates. For example, an extra strip of reinforcing material could be bonded to some or all of a central strip on the interior surface of a macrolayer A. That reinforcing strip could then be bonded to a corresponding portion of an exterior surface of the spring plate of an adjoining macrolayer B. The central strip of macrolayer A would be fixed relative to the corresponding portion of the exterior surface of the macrolayer B spring plate, but would be offset by the thickness of the reinforcing strip. In some embodiments, a damping material layer situated between two spring plates may extend across the entire width of the sole structure. For example, and instead of the direct contact between spring plates as seen in the central region of shoe 1 (FIGS. 4A1 and 4B1), the damping material layer may completely separate two spring plates in a central region.

In the embodiment of sole structure 10, the interior and exterior faces of damping material layer 22 are respectively bonded to spring plates 11 and 12. Similarly, the interior and exterior faces of damping material layer 23 are respectively bonded to spring plates 12 and 13. This need not be the case.

For example, in some embodiments one or more macrolayers could include spring plates in which the damping material layer is not bonded to one of the adjoining spring plates. For example, and referring to FIG. 4A1, an alternate embodiment could include a second macrolayer in which the second damping material layer (in a location similar to second damping material layer 22) is not bonded to an exterior surface of a spring plate (similar to spring plate 11) located immediately above, and the only connection between the macrolayers could be a fixation between the spring plates similar to where region 44 of spring plate 12 is bonded to spring plate 11. Similarly, a third damping material layer of a third macrolayer (in a location similar to third damping material layer 23) might not be bonded to an exterior surface of a spring plate (similar to spring plate 12) located immediately above, and the only connection between the macrolayers could be a fixation between the spring plates similar to where region 45 of spring plate 13 is bonded to spring plate 12.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination. With regard to claims directed to methods for fabricating an component or combination of components, a reference in the claim to a potential or intended wearer or a user of a component does not require actual wearing or using of the component or the participation of the wearer or user as part of the claimed process.

The invention claimed is:

1. A sole structure comprising:

a first spring plate having a medial span and a lateral span, a first medial outer edge extending upwardly from a periphery of a medial side of the medial span of the first spring plate such that it extends above an upper surface of the first spring plate and a first lateral outer edge extending upwardly from a periphery of a lateral side of the lateral span of the first spring plate such that it extends above an upper surface of the first spring plate;

a second spring plate having a medial span and a lateral span, a second medial outer edge extending upwardly from a periphery of a medial side of the medial span of the second spring plate such that it extends above an upper surface of the medial span of the second spring plate and a second lateral outer edge extending upwardly from a periphery of a lateral side of the lateral span of the second spring plate such that it extends above an upper surface of the lateral span of the second spring plate; and a damping material layer having a first portion located laterally between the first and second medial outer edges and a second portion spaced from the first portion and located laterally between the first and second lateral outer edges, wherein a lower surface of a portion of the first spring plate that is positioned between the medial and lateral spans and the upwardly extending lateral and medial edges of the first spring plate contacts an upper surface of a portion of the second spring plate that is positioned between the medial and lateral spans and the upwardly extending lateral and medial edges of the second spring plate.

2. The sole structure of claim 1, wherein the first and second medial outer edges, the first and second lateral outer edges and the damping material layer are located in heel and midfoot regions of the sole structure.

3. The sole structure of claim 1, wherein the first and second medial outer edges, the first and second lateral outer edges and the damping material layer are located in the heel, midfoot and forefoot regions of the sole structure.

4. The sole structure of claim 1, wherein each of the first and second spring plates is generally incompressible and elastically deformable, and the damping material layer is compressible.

5. The sole structure of claim 4, wherein each of the first and second spring plates is formed from materials that include at least one of a thermoplastic, a thermoplastic and glass fiber composite, a thermoplastic and carbon fiber composite, and a thermoplastic, carbon fiber and glass fiber composite, and the damping material layer is formed from a material that includes a compressible foam.

6. The sole structure of claim 1, further comprising:

a third spring plate having an upwardly extending third medial outer edge and an upwardly extending third lateral outer edge; and an additional damping material layer having portions located between the second and third medial outer edges and between the second and third lateral outer edges.

7. The sole structure of claim 6, wherein the first, second and third medial outer edges, the first, second and third lateral outer edges, the damping material layer and the additional damping material layer are located in heel and midfoot regions of the sole structure.

8. The sole structure of claim 7, wherein the first spring plate includes first medial and lateral spans located between the first medial and lateral outer edges, the second spring plate includes second medial and lateral spans located between the second medial and lateral outer edges, the third spring plate includes third medial and lateral spans located between the third medial and lateral outer edges, the damping material layer includes portions located between the first and second medial spans and between the first and second lateral spans, and the additional damping material layer includes portions located between the second and third medial spans and between the second and third lateral spans.

9. The sole structure of claim 1, wherein the second spring plate includes an attachment portion located in a longitudinally extending central region of the second spring plate, the second spring plate attachment portion being fixed relative to a corresponding portion of the first spring plate.

10. The sole structure of claim 9, wherein the damping material layer is not bonded to at least one of the first and second spring plates.

11. The sole structure of claim 9, wherein the damping material layer surrounds the attachment portion on the medial and lateral sides.

12. The sole structure of claim 1, wherein the first spring plate includes an upwardly extending first rear edge located in a heel region and connecting the first medial outer edge and the first lateral outer edge, the second spring plate includes an upwardly extending second rear edge located in the heel region and connecting the second medial outer edge and the second lateral outer edge, and the damping material layer includes portions located between the first and second rear edges.

13. The sole structure of claim 1, further comprising a heel counter configured to extend over and around a heel of a wearer of a shoe incorporating the sole structure, wherein the heel counter includes a portion that is an integral extension of the first spring plate.

14. The sole structure of claim 1, wherein the sole structure is part of a completed shoe, and further comprising:

an upper located above an interior surface of the first spring plate.

15. A sole structure, comprising:

a first spring plate;

a second spring plate, the second spring plate including a medial span, a lateral span, an attachment portion located in a longitudinally extending central region of the second spring plate between the medial and lateral spans, a medial outer edge extending upwardly from a periphery of a medial side of the medial span of the second spring plate such that it extends above an upper surface of the medial span of the second spring plate, and a lateral outer edge extending upwardly from a periphery of a lateral side of the lateral span of the second spring plate such that it extends above an upper surface of the lateral span of the second spring plate, the second spring plate attachment portion being fixed relative to a corresponding portion of the first spring plate; and a damping material layer having a first portion located laterally between the first spring plate and the medial outer edge of the second spring plate, and a second portion spaced from the first portion and located laterally between the first spring plate and the lateral outer edge of the second spring plate, wherein the first spring plate is at least partially nested within the second spring plate between the medial outer edge and the lateral outer edge, and wherein a lower surface of a portion of the first spring plate that is positioned between the medial and lateral spans and the upwardly extending lateral and medial edges of the first spring plate contacts an upper surface of a portion of the second spring plate that is positioned between the medial and lateral spans and the upwardly extending lateral and medial edges of the second spring plate.

16. The sole structure of claim 15, wherein the first spring plate, the second spring plate and the damping material layer are located in at least a heel region of the sole structure.

17. The sole structure of claim 15, wherein the first spring plate, the second spring plate and the damping material layer are located in at least a midfoot region of the sole structure.

18. The sole structure of claim 15, wherein the first spring plate, the second spring plate and the damping material layer are located in at least a forefoot region of the sole structure.

19. The sole structure of claim 15, further comprising:

a third spring plate, the third spring plate including an attachment portion located in a longitudinally extending central region of the third spring plate, the third spring plate attachment portion being fixed relative to a corresponding portion of the second spring plate; and an additional damping material layer located between the second and third spring plates in regions surrounding the third spring plate attachment portion.

20. The sole structure of claim 19, wherein the first spring plate, the second spring plate, the third spring plate, the damping material layer and the additional damping material layer are located in at least a heel region of the sole structure.

21. The sole structure of claim 19, wherein the first spring plate, the second spring plate, the third spring plate, the damping material layer and the additional damping material layer are located in at least heel and midfoot regions of the sole structure.

22. The sole structure of claim 19, wherein the first spring plate, the second spring plate, the third spring plate, the damping material layer and the additional damping material layer are located in at least heel, midfoot and forefoot regions of the sole structure.

23. The sole structure of claim 15, wherein the sole structure is part of a completed shoe, and further comprising:

an upper located above an interior surface of the first spring plate.

* * * * *